United States Patent [19]

Aizawa

[11] 3,934,808

[45] Jan. 27, 1976

[54] ADJUSTABLY SUSPENDED MOLD SECTIONS FOR FORMING A CONCRETE ROOM

[75] Inventor: Masuji Aizawa, Tokyo, Japan

[73] Assignee: Taihei Company Ltd., Tokyo, Japan

[22] Filed: Sept. 9, 1974

[21] Appl. No.: 504,369

[30] Foreign Application Priority Data

Sept. 11, 1973 Japan ..... 48-102334
May 2, 1974 Japan ..... 49-48722

[52] U.S. Cl. ..... 249/27; 249/39; 249/149; 249/152; 249/162; 249/181; 249/194

[51] Int. Cl.[2] ..... E04G 11/02

[58] Field of Search ..... 425/438, 441, 468, 450.1, 425/451.9; 249/27, 152, 162, 177–178, 249/180–182, 184–185, 39, 149, 194

[56] References Cited

UNITED STATES PATENTS

| | | | |
|---|---|---|---|
| 939,059 | 11/1909 | Morris | 249/177 |
| 952,869 | 3/1910 | Besser | 249/181 |
| 955,235 | 4/1910 | Wellman | 249/152 |
| 2,515,977 | 7/1950 | Banneyer | 249/39 |
| 2,598,830 | 6/1952 | Praeger | 425/441 |
| 3,558,095 | 1/1971 | McNiel | 249/27 |
| 3,801,059 | 4/1972 | Lippold | 249/152 |
| 3,822,853 | 7/1974 | Shelley | 249/27 |

FOREIGN PATENTS OR APPLICATIONS

| | | | |
|---|---|---|---|
| 255,593 | 10/1963 | Australia | 249/152 |

*Primary Examiner*—Robert D. Baldwin
*Assistant Examiner*—John McQuade
*Attorney, Agent, or Firm*—Meyer, Tilberry & Body

[57] ABSTRACT

A molding device comprising: an outer mold having a drive mechanism for moving side panels and end panels back and forth in the direction towards the center of the outer mold at the same time and a fastening means for automatically fastening the side panels and edge panels to a bottom panel; an inner mold having a drive mechanism for moving corner panels disposed between the side panels and end panels which are placed perpendicularly to each other, an actuating mechanism for moving the side panels and the end panels towards the center of the outer mold at the same time in cooperation with the back and forth movements of the corner panels, and a bottom panel having on its four peripheral sides plates which may be bent downwardly; molds for defining openings, which molds are adapted to be automatically fitted in or removed from the positions of openings to be defined in the inner and outer molds.

38 Claims, 36 Drawing Figures

ADJUSTABLY SUSPENDED MOLD SECTIONS FOR FORMING A CONCRETE ROOM

BACKGROUND OF THE INVENTION

This invention relates to a device for use in mechanically assembling and dismantling molds for producing a large size box type concrete block which has an open top surface and a closed bottom surface, and more particularly to a device for molding a box type concrete block having a projecting portion on the top side of the block, which portion extends inwardly.

There has been developed a technology for precasting a residential building in an attempt to lower the cost thereof. This technology has started with the so-called panel structure type builidng, in whcih prefabricated panels are assembled in a working site, and then proceeded with a capsule type, or a cubic structure type building, in which there are prepared box type concrete blocks of the number corresponding to rooms, and those blocks are assembled to a building of a several floors.

The production or molding of a large size box type concrete block dictates the use of an inner mold and outer mold. However, the assembling and dismantling operations for the molds have been resorted manually rather than mechanically. This apparently not only lowers the efficiency of operation but also impairs dimensional accuracy, thus failing to achieve the mass production of concrete blocks of the same configuration according to a production line system.

This is particularly true with the case where there is provided a projecting portion on the upper edge of a concrete block, which portion is directed inwardly. In this case, further increased difficulties are encountered with the dismantling operation of molds, with the accompnaying poor efficiency of operation. Like ordinary concrete molds in a working site, the molding device of this type consists of a pair of outer side panels and a pair of outer end panels in addition to a pair of inner side panels and a pair of inner end panels, thereby defining the outer side surfaces and inner side surfaces of a box type concrete block. It is therefore a common practice to use hydraulic jacks for simply moving those side panels and end panels back and forth in the horizontal direction to thereby bring those panels to assembling and dismantling positions, respectively.

However, those arrangements still fail to be a success in the mass production of box type concrete blocks.

In other words, such back and forth movements of the side panels and end panels interfere with the delivery of the concrete blocks after their curing, thus impairing the efficiency of operation. This is particularly true with the inner mold, because when one pair of side panels and end panels are simply moved back, the other pair of panels are not allowed to move back due to the interference with the former pair of panels, while upon assembly, one pair of panels should be assembled, after the other has been assembled, thus posing many difficulties in carrying out the assembling and dismantling operations mechanically.

Referring to the bottom mold, there has been experienced considerable difficulties in removing the inner mold from the bottom panel, so that the bottom inner mold has not been used hitherto, but the bottom panel is produced manually, and then concrete is poured into molds to produce side panels and end panels, after the concrete of the bottom panels has been cured or hardened. It is needless to mention that such an operation impairs the efficiency of operation to a great degree.

In addition to such problems, there have been left many problems in technology, which have to be solved in improving the efficiency of assembling operation of molds.

SUMMARY OF THE INVENTION

It is a principal object of the present invention to provide a molding device suited for the mass production of concrete blocks according to a continuous molding operation, the aforesaid molding device permitting ready but rapid assembling and dismantling operations automatically.

It is another object of the present invention to provide a molding device having an outer mold, in which the four peripheral panels may be moved outwardly at the same time to be detached from the concrete product, while those four peripheral panels may be moved inwardly for molding to remain in their molding portions.

It is a further object of the present invention to provide a mold device having an outer mold in which the four peripheral panels may be fastened to the bottom panel and detached therefrom automatically.

It is a further object of the present invention to provide a molding device having an inner mold, in which the four peripheral panels may be moved inwardly at the same time to be detached from a concrete product, while for the molding operation, the four side panels may be moved outwardly to the molding positions.

It is a yet further object of the present invention to provide a molding device having an inner mold, in which the four peripheral panels may be moved inwardly without interference with each other to be collapsed to a small size, thus causing no interference with flanges extending inwardly and formed on the upper edges of the peripheral walls of a concrete block, when slung upwardly to be detached from the mold.

It is a still further object of the present invention to provide a molding device having an inner mold, in which there are provided panels on the four corners defined between the four peripheral panels, whereby the aforesaid panels may be inwardly moved to leave a space permitting the inward movement of the four peripheral panels without interference with each other and whereby there is provided a mechanism in which the four side panels may be moved in cooperation with the movements of the four side panels.

It is a further object of the present invention to provide a molding device in which a mechanism for moving the aforesaid plates and four peripheral panels may be driven by means of a single power source.

It is a further object of the present invention to provide a molding device having an inner mold, which is provided with a bottom panel that may be compressed or collapsed to a small size when detached from the formed concrete block by being slung up together with the four peripheral panels.

It is a further object of the present invention to provide a molding device having a sling means which permits the slinging of the outer mold and inner mold together, after molding of a concrete block, while permitting the location of the inner mold in spaced relation from the outer mold, upon assembly.

It is a further object of the present invention to provide a molding device provided with molds for defining openings in the peripheral four panels, which molds may be assembled or dismantled automatically.

It is a further object of the present invention to provide a molding device provided with molds for defining openings in the four peripheral panels, which molds may be fastened to the four peripheral panels of the inner mold or may be detached therefrom automatically.

It is a further object of the present invention to provide a molding device in which the peripheral four side panels of the outer mold may be moved at a synchroneous timing with respect to the upper and lower sides thereof.

It is a further object of the present invention to provide a molding device, in which the peripheral four side panels of the outer mold may be moved in cooperation with each other.

According to the present invention, there is provided, a molding device for producing a box type concrete block, comprising:

an outer mold consisting of a bottom panel mounted on a base support, two parallel opposing side panels and two parallel opposing end panels which extend at a right angle to said side panels, said respective side panels and end panels being movable back and forth, i.e., inwardly or outwardly of said outer mold and located along the peripheral four sides of said bottom panel;

an inner mold consisting of a bottom panel, two parallel opposing side panels, two parallel opposing end panels, and corner panels disposed on the corners defined by said two side panels and said end panels, said corner panels being movable back and forth, i.e., inwardly or outwardly of said inner mold, said side panels and end panels being movable back and forth, i.e., inwardly or outwardly of said inner mold; and a suspension frame suspendable together with said inner mold and outer mold by means of a hoisting means, said suspension frame being adapted to support said inner and outer molds.

DESCRIPTION OF THE PREFERRED EMBODIMENTS

Figure 1:
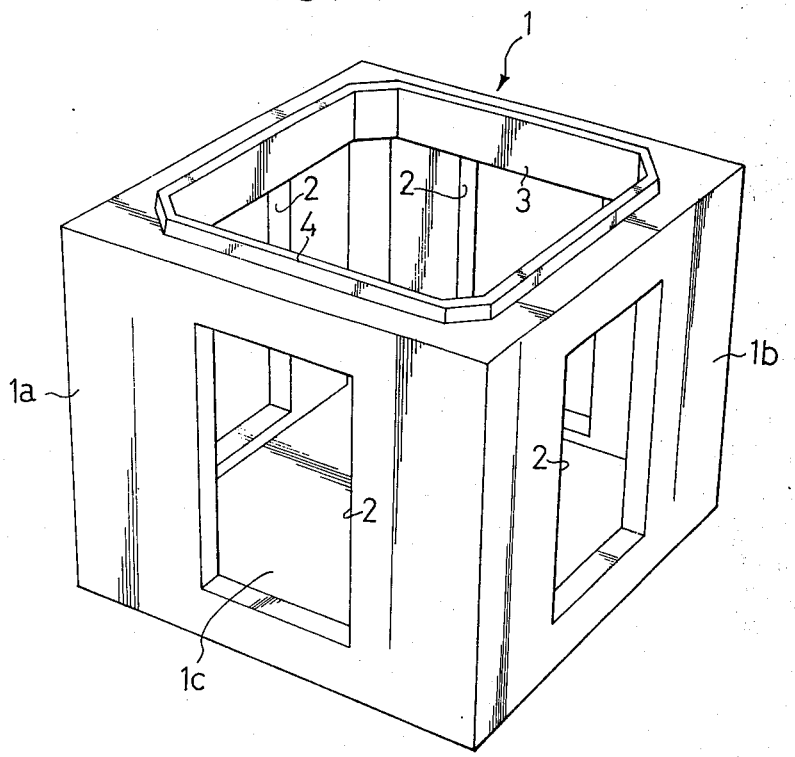
FIG. 1 is a perspective view of a box type concrete block formed by using a molding device according to the present invention.
Figure 2:
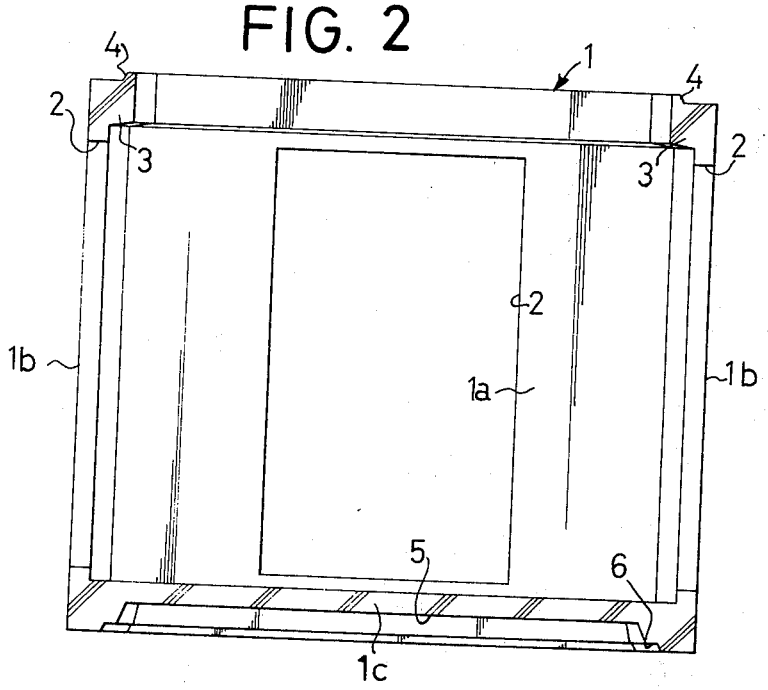
FIG. 2 is a longitudinal cross sectional view of a box type concrete block as shown in FIG. 1.

Referring now to FIGS. 1 and 2, there is shown at 1 a box type concrete block according to the present invention. The concrete block is of a open top surface and closed bottom surface type and of a box shaped, integral type reinforced concrete block construction. The block 1 consists of parallel opposing side panels 1*a*, 1*a*, end panels 1*b*, 1*b* and a slab 1*c* of an closed structure but integral therewith. There are provided openings 2 in the side panel 1*a* and end panel 1*b*, which openings serve as entrances or exits. Provided on the inner top edge portions of the side panels 1*a* and end panels 1*b* are inwardly directed flanges 3 along the four peripheral sides. As a result, the inner mold can not be slung upward, unless the inner mold is collapsed after molding. Provided on the top inner surface of the inwardly directed flanges 3 are ribs 4 which are integral therewith. Provided in the slab 1*c* as shown in FIG. 2 is a square recessed portion 5, while there are provided cut-away grooves 6 extending along the four peripheral sides of the recessed portion 4. Ribs 4 may be fitted in the cut-away grooves 6.

Meanwhile, the dimensions of the each portion of the aforesaid concrete block may be selected as required, and the concrete block may be formed to eigher cubic rectangular parallopiped shape commensurate with the design consideration of a concrete mold. In addition, the number and dimensions of openings may be selected as desired.

Alternatively, the aforesaid concrete block may be turned upside down, thereby using same as an open bottom type concrete block.

As has been described earlier, for producing a concrete block of such a type, there are required an inner mold and an outer mold. The present invention is particularly associated with a molding device for produicing the aforesiad concrete block, and description will be given of a concrete block 1 having side panels and end panels of an equal width.

Figure 3:
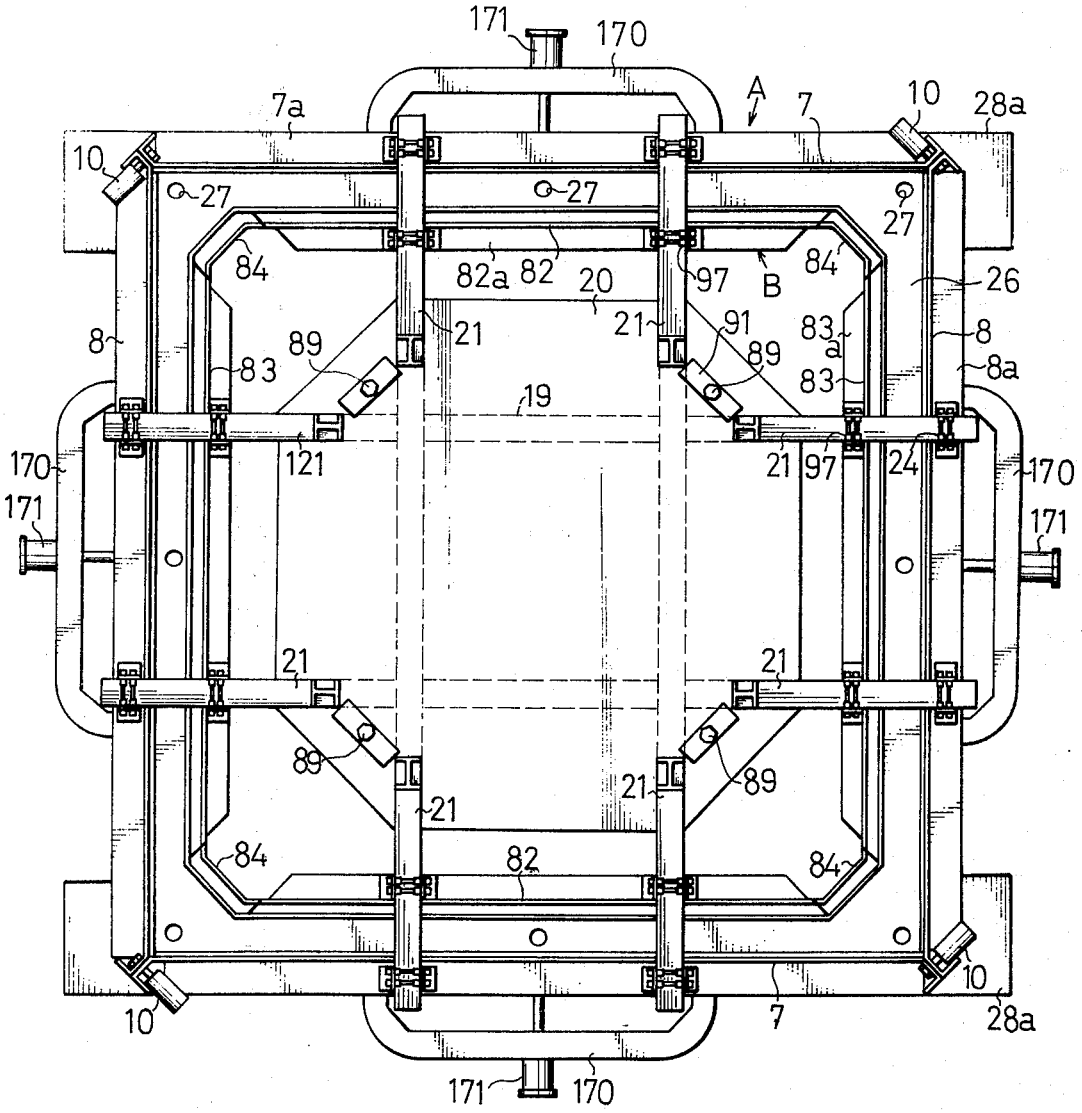
FIG. 3 is a plan view of the entire molding device, with the internal mechanism shown omitted.

FIG. 3 shows an outer mold A and an inner mold B used in combination therewith, embodying the present invention. For simplicity, detailed portions of the device are omitted, only showing outline thereof.

Firstly, the outer mold consists of a pair of parallel side panels 7 defining the outer surfaces of tfhe side walls 1a of the concrete block 1, a pair of end panels 8 which oppose to each other and are placed in parallel, defining the outer surfaces of the end walls 1b of the concrete block 1, and a bottom panel 9 defining the outer surface of a slab 1*c* of the concrete blcok 1. The side panels 7 and end panels 8 are provided with flanges 7*a*, 7*b* and 8*a*, 8*b*, on the upper and lower edges thereof, respectively. Interposed between the upper and lower flanges are reinforcing ribs (not shown) which extend in parallel with the flanges. On the other hand, the side panels 7 and end panels 8 are provided with longitudinal reinforcing ribs, which are omitted because of their well known construction.

The side panels 7 may be moved back and forth in mutually opposing direction, while the end panels 8 are disposed at a right angle to the side panels 7 but may be moved back and forth in mutually opposing direction. For the back and forth movements of those side and end panels, there are used four hydraulic cylinders which are each provided on the respective corners of the outer mold A or fluid pressure type cylinders 10 consisting of air cylinders.

Figure 4:
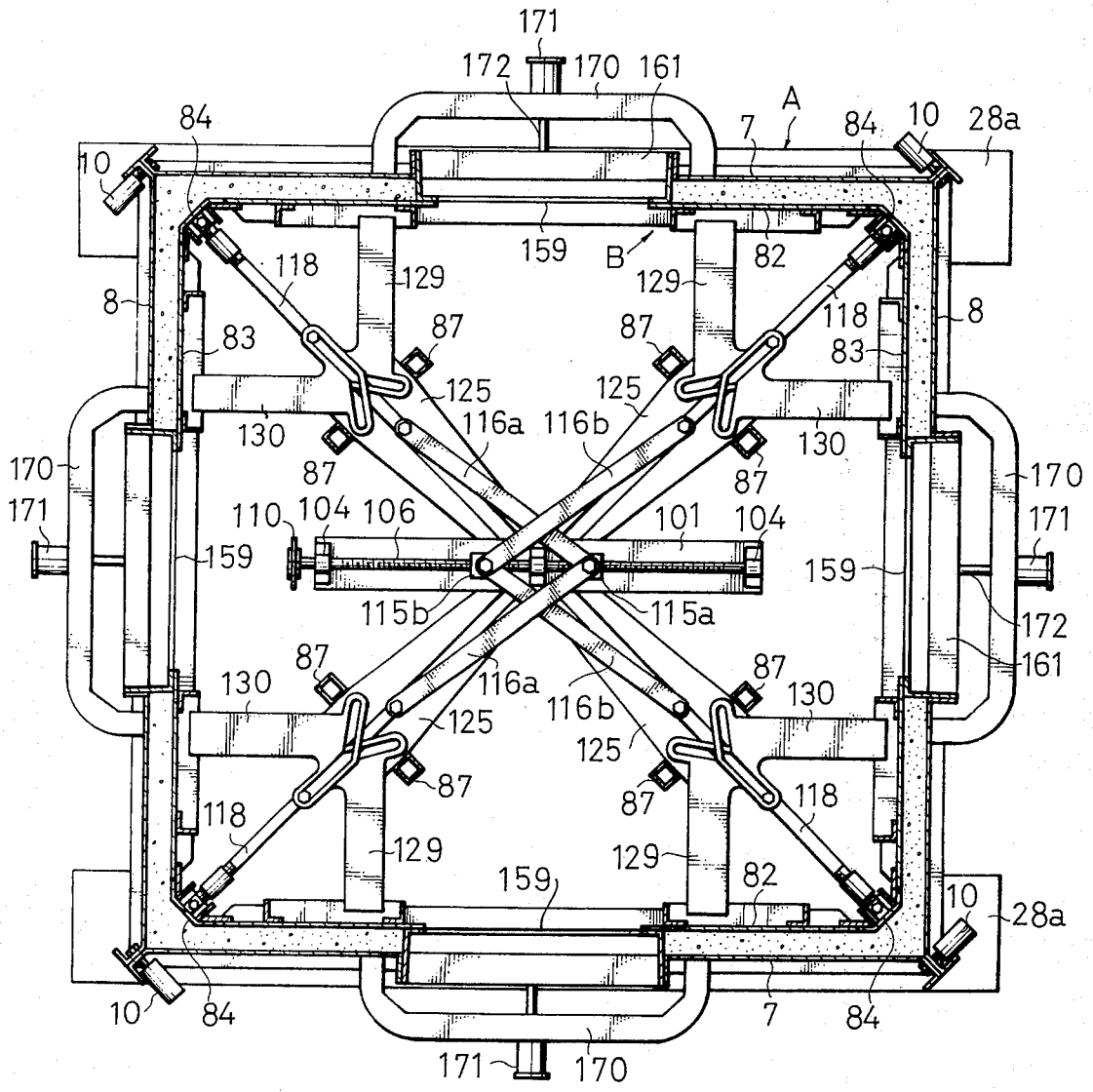
FIG. 4 is a transverse cross-sectional view of the molding device, the bottom panel of the inner mold shown omitted.
Figure 6:
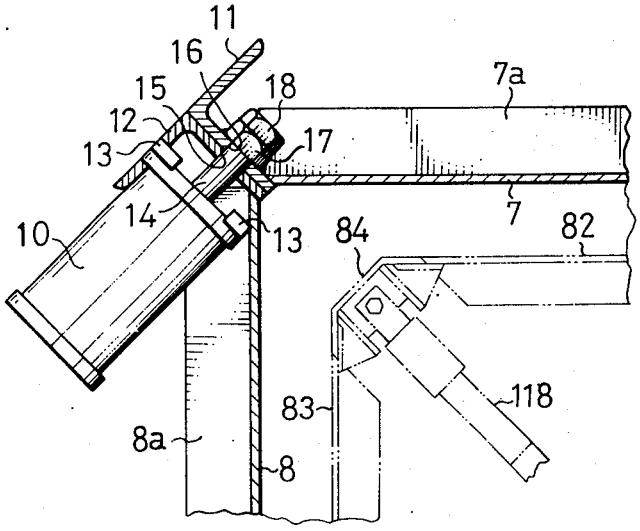
FIG. 6 is a transverse cross-sectional view, partly enlarged, of the corner portions of the outer mold which is in molding position.
Figure 7:
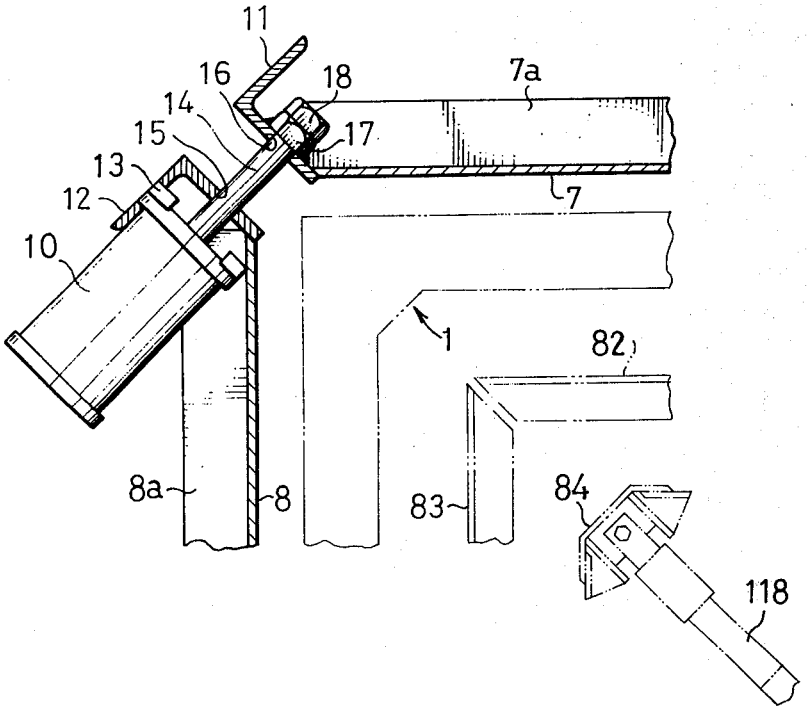
FIG. 7 is a transverse cross-sectional view, partly enlarged, of the corner portions of the outer mold.
Figure 8:
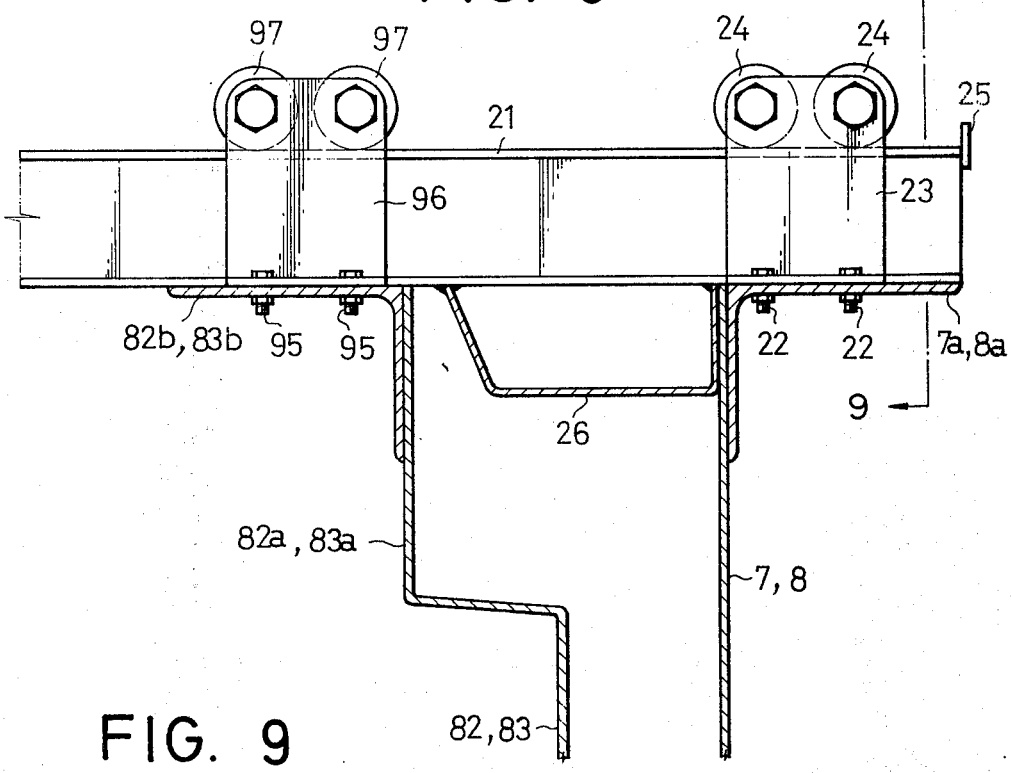
FIG. 8 is a fragmental longitudinal cross-sectional view of the outer and inner molds which are movably suspended by a suspension frame.

FIGS. 8 and 4 show only the outline of attaching positions of the cylinders 10, while the detailed attaching condition and operating condition thereof are shown in an enlarged view in FIG. 6 and 7.

Affixed to the side panel 7 on its opposite ends is an angle type supporting frame 11 which extends at an angle of 45° to the side panel 7, while a supporting plate 12 is affixed to the end panel 8 in opposing relation to the supporting frame 11. At least two cylinders 10 are located on the respective corners in the upper and lower ends as shown in FIGS. 3 and 4, with the directions of the cylinders 10 on the respective corners are opposed to each other.

As shown in FIGS. 6 and 7, the cylinder 10 is affixed to the supporting frame 12 and to the flange 8a by means of a fixing member 13 at an angle of 45° to the end panel 8, while a piston rod 14 of the cylinder 10 is sealingly inserted into a through-hole 15 provided in the supporting plate 12, with its tip portion being threaded into a nut 17 affixed to the back surface of the supporting frame 11 and further threaded into a nut 18, whereby the tip portion is affixed to the supporting frame 11.

Meanwhile, the angle of cylinder 10 and the direction of piston rod 14 are opposite to those of the cylinder and piston rod disposed on the other side panel 7 and end panel 8.

Since the cylinder 10 is disposed at an angle of 45° to the side panel 7 and end panel 8, the side panels 7,7 will move back and forth, when those cylinders 10 are actuated simultaneously, whereby the side panels 7, 7 will move to or from each other, while the end panels 8, 8 will likewise move to or from each other, so that the outer mold will be collapsed to the assembling position or retracted from such position to the retracted position after placing concrete in the mold, thereby exposing the concrete block 1 as shown in FIG. 7.

Figure 5:
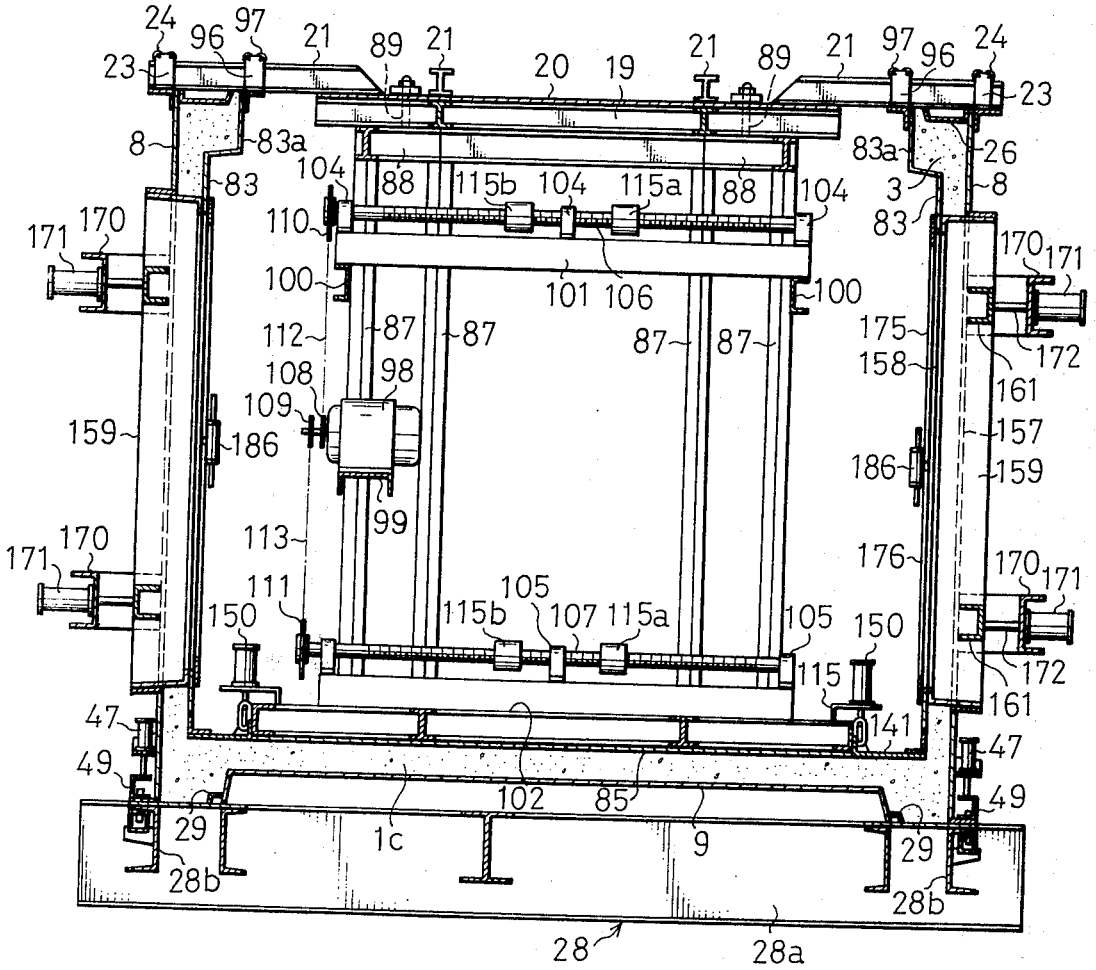
FIG. 5 is a longitudinal cross-sectional view of a molding device, with the construction inwardly of the side panels being shown omitted.

Referring to FIGS. 3 and 5, shown at 19 is a suspension frame which is made by disposing I, H or channel steels to a lattice pattern and by welding each other to give an integral body. The suspension frame 19 is adapted to be slung by means of an overhead crane or hoisting means and move back and forth or to the left and right, with a platform 20 mounted on the top surface thereof. The side panel 7 and end panel 8 are movably suspended by the suspension frame 19, respectively.

Figure 9:
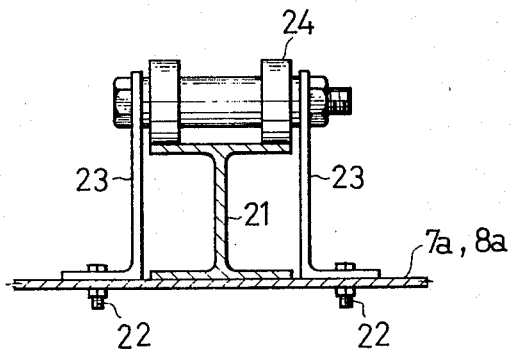
FIG. 9 is a cross-sectional view taken along the line 9—9 of FIG. 8.

The detailed constuction of the suspension frame is shown in FIGS. 8 and 9. In other words, I-beam 21 is rigidly coupled to the ends of shape steels of the suspension frame 19, while there are rotatably journaled a set of two rollers 24, 24 in a bracket 23 affixed to the upper flanges 7a and 8a of the side panel 7 and end panel 8 by means of a bolt 22. At least two sets of rollers 24, 24 are provided for the respective side panel 7 and end panel 8. As a result, the entire body of the outer mold A may be suspended by the suspnesion frame 19, while the side panel 7 and end panel 8 are guided by the I-beam 21 through the medium of roller 24 to thereby move back and forth. Provided at the ends of I-beam 21 are stoppers 25, such that the aforesaid rollers 24, 24 will not run off the I-beam 21. Affixed to the undersurface of the I-beam 21 is an upper lid 26 substantially of a channel type for defining the top edge, i.e., rib 4 of a concrete block 1. Provided in the upper lid 26 at a given position is a concrete inlet 27. Now, description will be given of means for fastening the side panel 7 and end panel 8 to the bottom panel, with the side panel 7 and end panel 8 placed to given positions.

Figure 10:
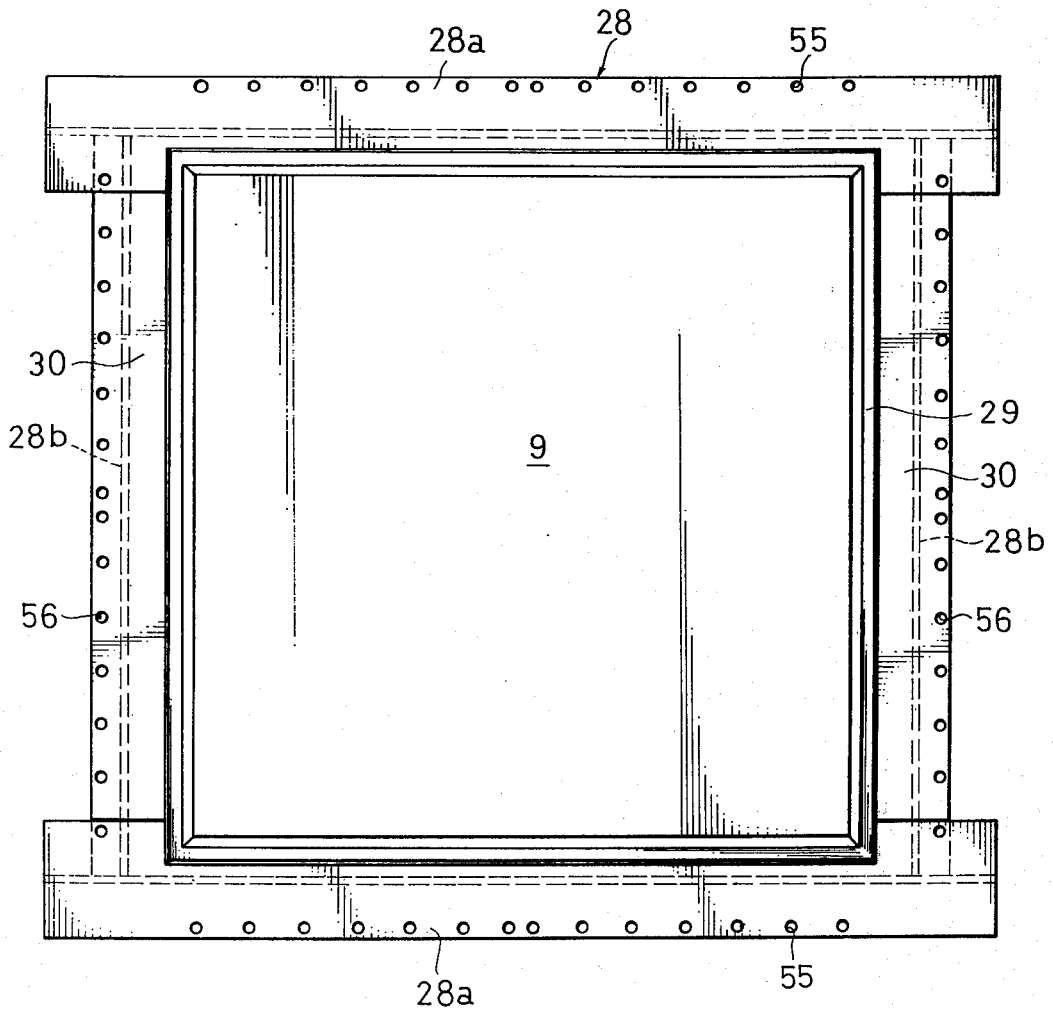
FIG. 10 is a plan view of a base support constituting the bottom portion of an outer mold and a bottom panel fixed thereto.

Referring now to FIG. 10, the bottom panel 9 is rigidly mounted on a base support 28 which consists of a pair of parallel beams 28*a* made of I-steels, a pair of parallel beams made of channel steels for coupling the ends of the beams 28*a*, and a beam 28*c* made of H-steel for interconnecting the intermediate portions of a pair of parallel beams 28*a*. In this particular case, the bottom panel 9 has a build-up portion so as to define a recessed portion 5 in the slab 1*c* of the concrete block 1, while a small frame 29 extends along the sides of the bottom panel 9 so as to define a cut-away portions 6, and is rigidly mounted on the base support together with the bottom panel 9. The beams 28*b* consist of a set of two channel shaped steels disposed adjacent to each other, and a steel plate 30 rigidly mounted on the top surface of the steels in a manner that the top surface of the steel plate 30 is flush with the top surface of the beams 28*a*. There is provided flanges 31 and 32 along the top edges of the base support 28, which flanges are the upper flanges of the beams 28*a* and 28*b*, respectively.

Figure 11:
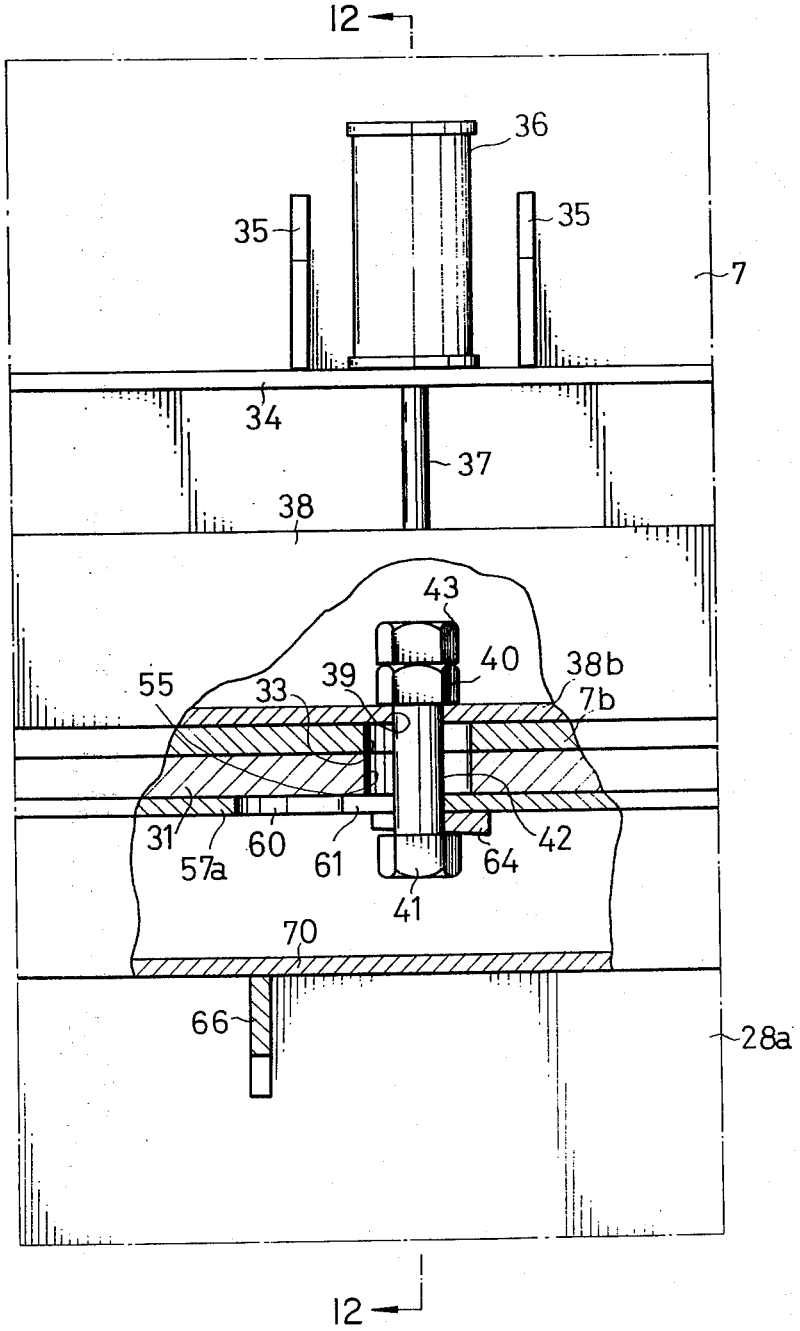
FIG. 11 is partly fragmental front view of the side panels of an outer mold fastened to a base support.
Figure 12:
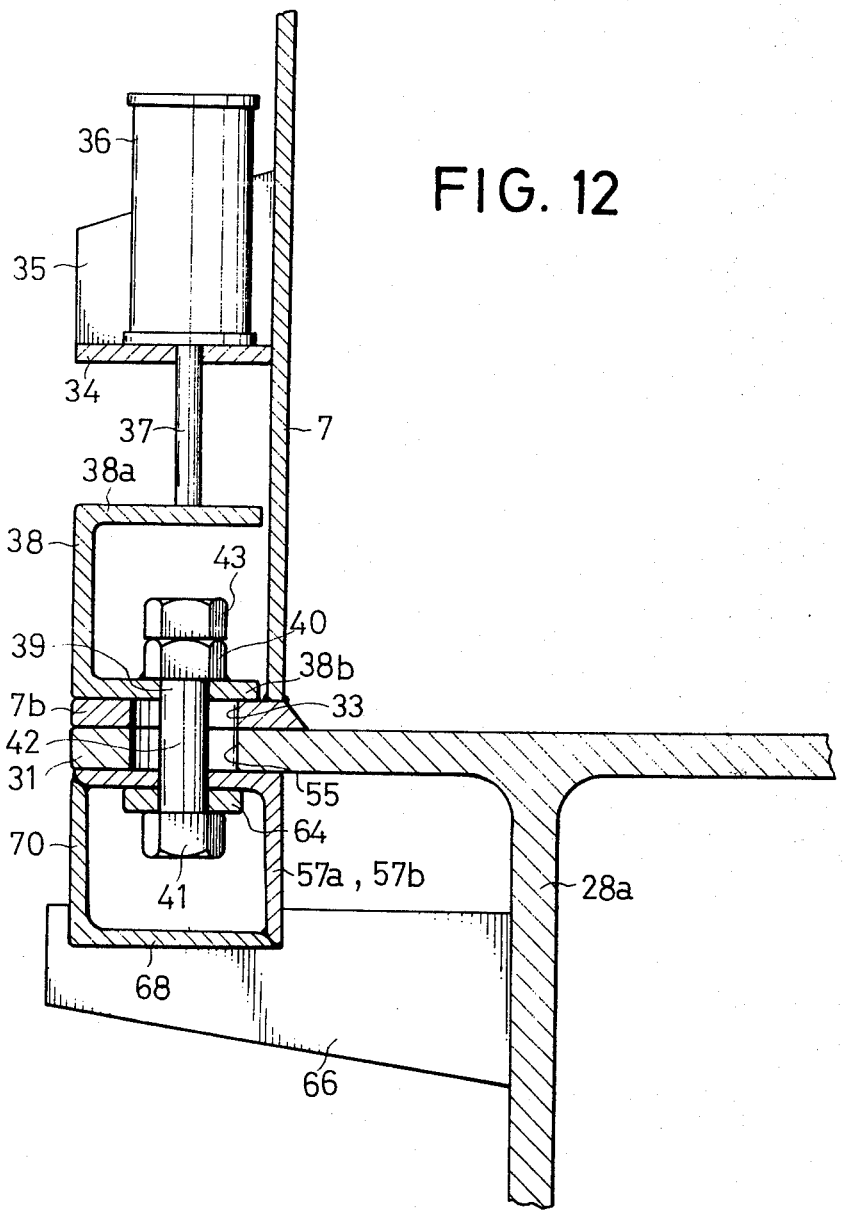
FIG. 12 is a cross-sectional view taken along the line 12—12 of FIG. 11.

As shown in FIG. 11, the lower flange 7*b* of the side panel 7 is mounted on the flange 31 of the base support 28, while the lower flange 8*b* of the end panel 8 is mounted on the steel plate 30 on the flange 32 of the base support 28.

A plurality of through-holes 33 are provided in the flange 7*b* of the side panel 7 at a given spacing. Provided on the upper surface of the flange 7*b* is an intermediate flange 34 which extends in parallel therewith, and a reinforcing rib 35 is affixed to the flange 34, together with the at least two fluid pressure cylinders 36. The piston rod 37 of the cylinder 36 extends downwardly in projecting relation, while the upper side 38*a* of the supporting frame 38 consisting of a steel of a channel type is affixed to the tip of the piston rod 37. The lower side of the supporting frame 38 which opposes to the upper side 38*a* has a through-hole therein in the position corresponding to the through-hole 33 in the flanges 7*a*, while a nut 40 is placed on the upper surface of the lower side 38*b* of the supporting frame 38 in the position where the hole in the nut is in register with the through-hole 39.

Figure 15:
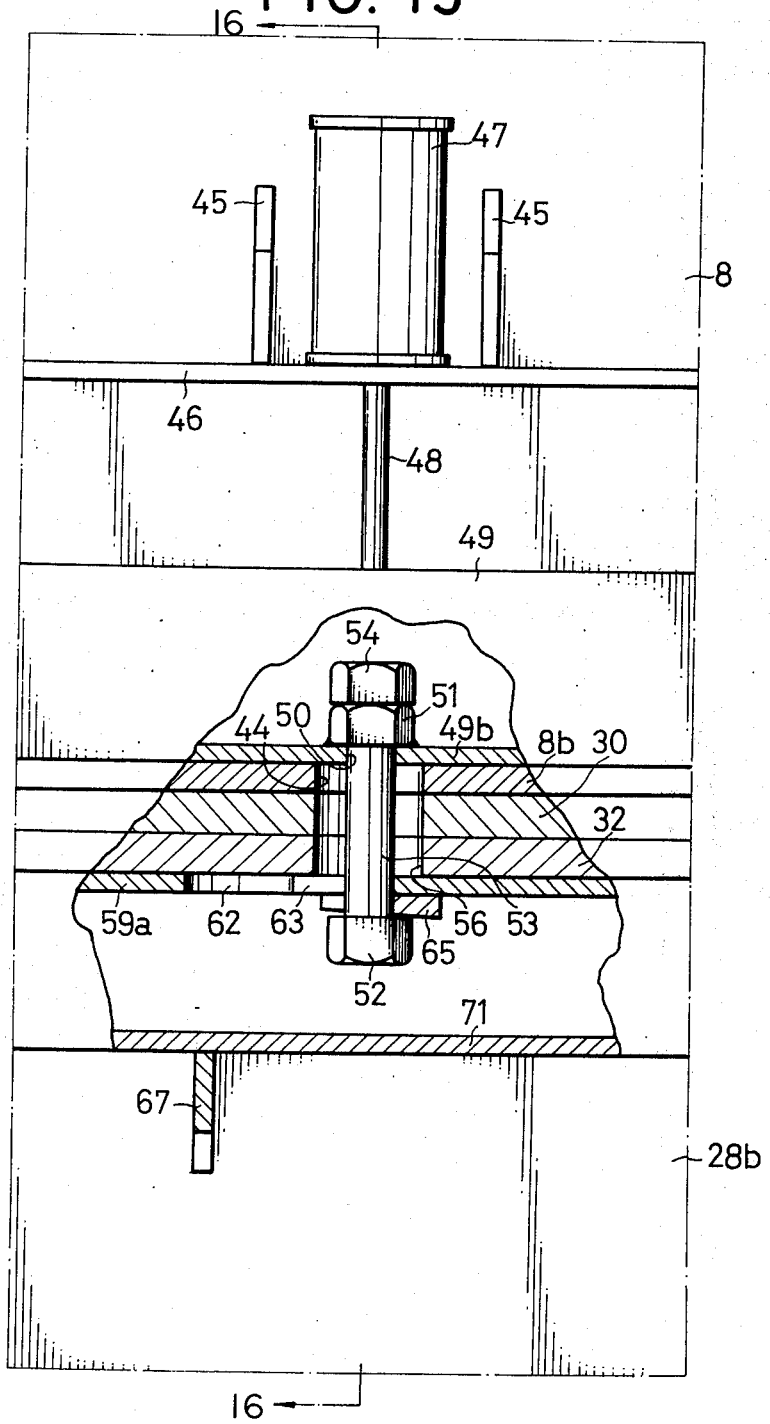
FIG. 15 is partial front view, partly broken, of the end panels of an outer mold fastened to a base support.
Figure 16:
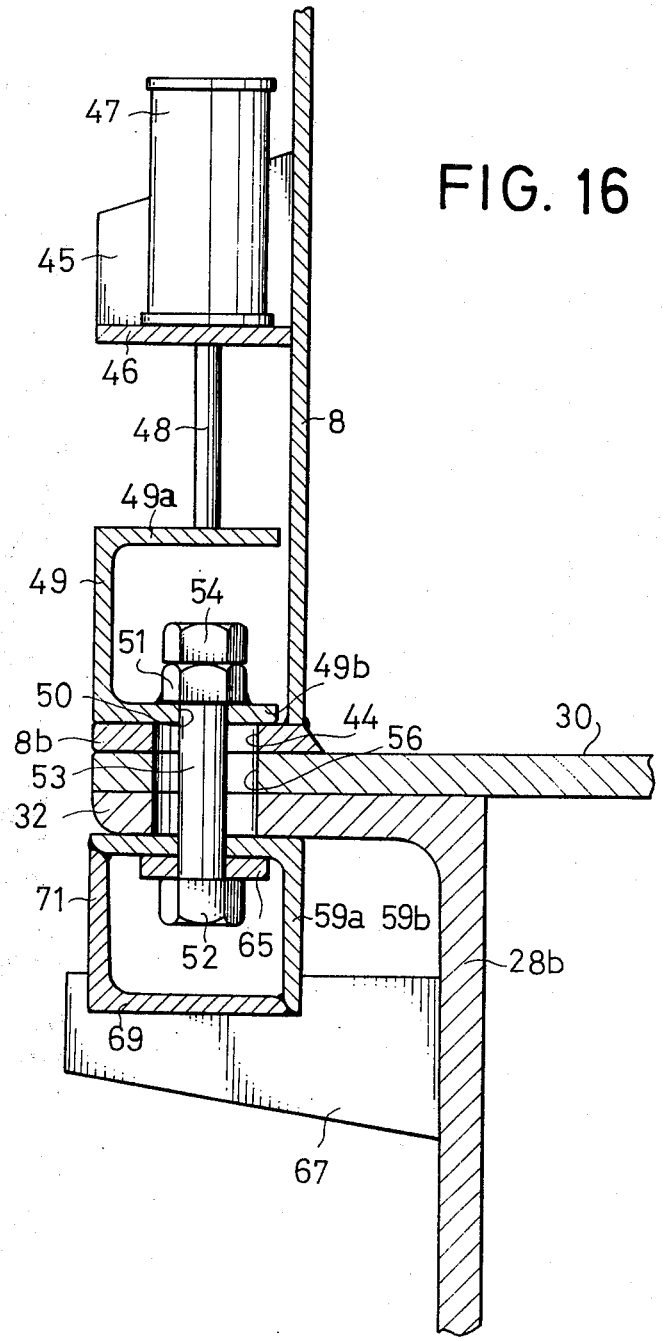
FIG. 16 is a cross-sectional view taken along the line 16—16 of FIG. 15.

A tightening bolt 42 is threaded into the nut 40 through the through-hole 39 from below, while the bolt 42 has a circular, square or other suitable shape retaining or engaging portion 41 at its lower and, and thus the bolt 42 is tightened by means of the nut 43. Accordingly, the fastening bolt 42 may be adjusted for its length projecting from the flange 7*b*. Provided in the flange 8b on the lower edge of the end panel 8 is a plurality of through-holes 44 at a given spacing as in the previous case. Like the side panel 7, as shown in FIG. 15, there is provided an intermediate flange 46 on the flange 8b of the end panel 8, which flange 46 is reinforced with a reinforcing rib 45. Affixed to the tip of the piston rod 48 of the hydraulic cylinder 47 which is rigidly mounted on the intermediate flange is an upper side 40*a* of the supporting body 49, while there is provided a through-hole 50 in the lower side 49*b* of the supporting body 49. A nut 51 is affixed thereon so as to register with the through-hole 50 into the nut 51 may be tightened with a nut 54 placed on the nut 51, the aforesaid bolt 35 having a retaining portion 52 at its lower end.

The sizes of the through-holes 33 and 44 provided in the flange 7*b* of the side panel 7 as well as in the flange 8*b* of the end panel 8 are such as to allow the passage of the retaining portions 42 and 52 of the tightening bolts 42 and 53 therethrough.

When the side panel 7 and end panel 8 are in the molding position of the concrete block 1, the through-hole 55 in the flange 31 of the base support 28, on which are mounted respective flanges 7*b* and 8*b*, and the through-hole 56 provided in the flange 32 and steel plate 30 are brought to positions corresponding to the through-holes 33, 44. The sizes of the through-holes 55 and 56 are such as to permit the passage of the retaining portions 41 and 52 of the tightening bolts 42 and 53 therethrough. The dimensions and positions of members associated are such that when the tightening bolts 42 and 53 are pushed out downwardly due to the operation of the fluid pressure cylinders 36 and 47, the tightening bolts 42 and 53 may pass through the through-holes 55 and 56 in the base support 28 to project downwards therefrom.

Figure 19:
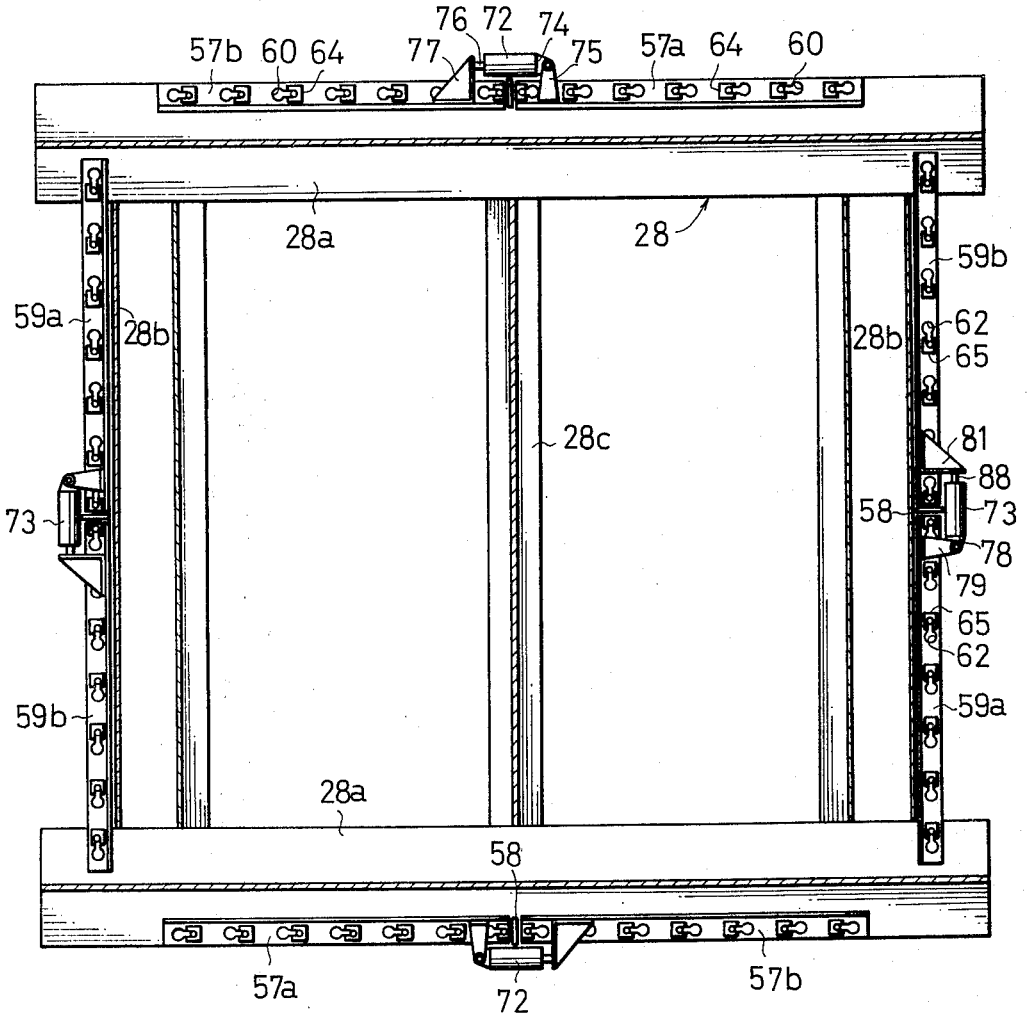
FIG. 19 is a bottom view of a base support.

As shown in FIG. 19, there are provided fastening plates 57*a* and 57*b* on the edge of the undersurface of the flange 31 of the base support 28 in a manner that the fastening plates 57*a* and 57*b* are slidable relative to the opposing direction of the end panels 8, 8, with a stopper 58 being interposed between the fastening plates 57*a* and 57*b*. On the other hand, there are provided fastening plates 59*a* and 59*b* on the edge of the undersurface of the flange 32 of the base support 28 in a manner that the fastening plates 59*a* and 59*b* are slidable relative to the opposing direction of the side panels 7, 7, with a stopper 58 being interposed between the actuating plates 59*a* and 59*b*. The fastening plates 57*a*, 57*b* are made of angle steels having a length which is substantially half the length of the flange 7*b* of the side panel 7, respectively, while there are provided through-holes 60 in the horizontal sides of the plates 57*a* and 57*b* in the positions corresponding to that of the through-hole 55 in the base support 28, the through-holes 60 being of such sizes that permit the passage of the retaining portion 41 of the tightening bolt 42 therethrough. Continuous with the through-hole 60 but directed towards the opposing direction of the fastening plates 57*a* and 57*b* is an elongated hole 61 having a diameter substantially the same as that of the tightening bolt 42. On the other hand, the fastening plates 59*a* and 59*b* are made of angle steels and have lengths which are substantially half the length of the flange 8*b* of the end panel 8, while there is provided a through-hole 62 in the horizontal side thereof in the position corresponding to that of the throughhole 56 in the base support 28, the through-hole 62 being of such a size as to permit the retaining portion 52 of the tightening bolt 53. On the other hand, continuous with the through-hole 62 but in the opposing direction of the fastening plates 59*a*, 59*b* is an elongated hole 63 having a diameter substantially the same as that of the fastening bolt 53.

Wedges 64 and 65 of 'U' shape are rigidly mounted on the undersurfaces of the fastening plates 57*a*, 57*b* and 59*a*, 59*b*, respectively, in a manner to surround the elongated holes 61, 63. The wedges 64, 65 have thickness which are increasing from their open ends to the bases, with the open ends being directed towards the through-holes 60, 62.

The respective fastening plates 57*a*, 57*b* and 59*a*, 59*b* are located in opposing relation, i.e., 57*a* to 57*a* and 57*b* to 57*b* and so on. In addition, the plates 57*a*, 57*b* and 59*a*, 59*b* are slidably mounted on guide grooves 68, 69 provided in the supporting members 66, 67 which project from the beams 28*a*, 28*b*.

Shown at 70 and 71 are sliding members joined to the fastening plates 57*a*, 57*b* and 59*a*, 59*b* for causing the fastening plates 57*a*, 57*b* to slide on the supporting members 66, 67.

Hydraulic cylinders 72, 73 are provided for moving the fastening plates 57*a*, 57*b* and 59*a*, 59*b* in the opposite direction to each other, respectively, as shown in FIG. 19. The fluid pressure cylinder 72 is mounted on the bracket 74 which in turn is provided on the edge portion of the fastening plate 57*a*, while the piston rod 76 is secured to bracket 75 provided on the side edge portion of the other fastening plate 57*b*. The fluid pressure cylinder 73 are likewise secured to the fastening plate 59*a* through the medium of a bracket 81 to the other fastening plate 59*b*.

Figure 13:
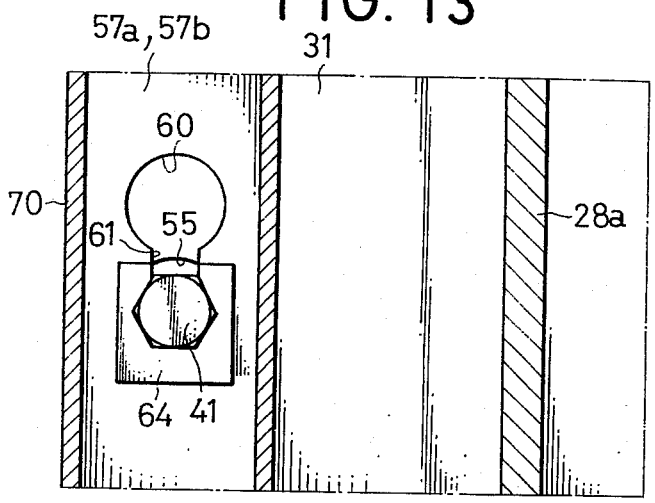
FIG. 13 is a partial bottom view as viewed from below a base support flange, of the side panels of an outer mold fastened to a base support.
Figure 17:
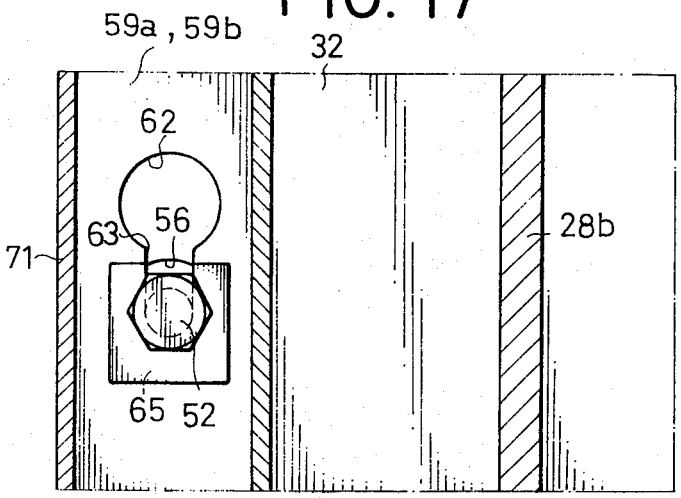
FIG. 17 is a partial bottom view as viewed from below the base support flange, of the end panels of an outer mold fastened to the base support.

Accordingly, when the fluid pressure cylinders 72, 78 are extended so as to cause the fastening plates 57*a*, 57*b* and 59*a*, 59*b* to slide away from each other, then the wedges 64, 65 will get into the root portion of the retaining portions 41, 52 of the fastening bolts 42, 53 which project downwards through the through-holes 55, 56 in the base support 28, thereby tightly fastening the flange 7*b* of the side panel 7 and the flange 8*b* of the end panel 8 to the base support 28. FIGS. 13 and 17 show the fastened condition.

Subsequently, when the fluid pressure cylinders 72, 73 are compressed simultaneously to cause the fastening plates 57*a*, 57*b* and 59*a*, 59*b* to slide towards each other, then the wedges 64, 65 will be detached from the root portions of the retaining portions 41, 52 of the tightening bolts 42, 53 and then the tightening bolts 42, 53 will be retracted into the through-holes 60, 62 in the fastening plates 57*a*, 57*b* and 59*a*, 59*b*.

Figure 14:
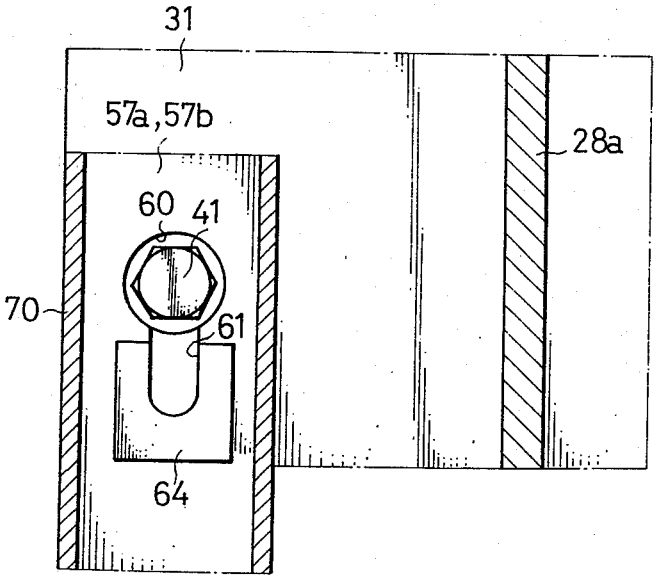
FIG. 14 is a partial bottom view as viewed from below the base support flange, of the side panels of an outer mold fastened to a base support.
Figure 18:
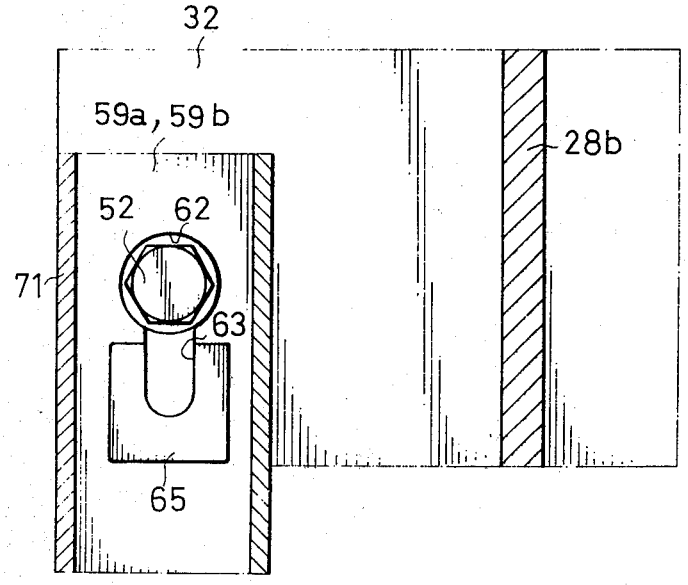
FIG. 18 is a partial bottom view as viewed from below the base support flange, of the end panels of an outer mold fastened to a base support.

This condition is shown in FIGS. 14 and 18. Under such a condition, when the fluid pressure cylinders 36, 47 are actuated, then the tightening bolt 42 will be raised through the through-holes 60, 55, 33, while the tightening bolt 53 will be raised through the through-holes 62, 56, 44, so that the retaining portions 41, 52 thereof will be positioned above the undersurface of the flnage 8b of the end panel 8 and the flange 7*b* of the side panel 7.

As a result, there is no longer imposed any restriction on the side panel 7 and end panel 8, so that the side panel 7 and end panel 8 may be moved back and forth and the outer mold A may be dismantled.

Alternatively, if the directions of elongated holes 61, 61 as well as elongated holes 63, 63 are directed in the direction of bringing the fastening plates 57*a*, 57*b* and 59*a*, 59*b* apart from each other, the operation reversal to those of the aforesaid fluid pressure cylinders 72, 73 may effect the fastening or detachment of the flanges to or from the base support.

Next, when the outer mold is to be assembled, the side panel 7 and end panel 8 are suspended along the guide pin(not shown) downwards from above, until the flanges 7*b* and 8*b* are mounted on the base support 28, then the through-holes 33, 44 in the flanges 7*b*, 8*b* are located so as to register with the through-holes 55, 56 in the base support 28. Under this condition, the fluid pressure cylinders 36, 47 are extended so that the tightening bolts 42, 53 are lowered through the through-holes 38, 55, 69, and 44, 56, 62, and then the hydraulic cylinders 72, 73 are extended so as to fasten the flanges 7*b*, 8b to the base support 28 by means of the fastening plates 57*a*, 57*b* and 59*a*, 59*b*.

Turning now to the inner mold B, the mold B consists of a pair of parallel opposing side panels 82, 82 which define the inner surfaces of the side walls 1a of the concrete block 1; a pair of parallel, opposing end panels 83, 83 which define the inner surfaces of the end walls 1b of the concrete block 1; four corner panels 84 to be fitted between the side panels 82 and end panels 83 for defining the corner inner surfaces of the concrete block 1; and a bottom panel 85 which defines the top surface of the slab 1c of the concrete block 1.

Provided on the side panel 83 and end panel 83 are projecting portions 82*a*, 83*a* having 'L' shape in their cross sections for the purpose of forming an inwardly directed flange 3 of a concete block 1. The side panels 82 and end panel 83 are provided with flanges 82*b*, 83*b* at the upper edge portion thereof and ribs (not shown) extending longitudinally and transversely and provided inside the panel.

A corner panel 84 has projecting pieces 84*a* on its opposite edges, which pieces extend at an angle of 135° to the corner panel 84, and has a trapezoid shape in its corss section. In addition, a stopper 86 is attached to the inner surface of the projecting piece 84*a*, which stopper extends beyond the edge of the projecting piece 84*a*. Thus, when the side panel 82 and end panel 83 are joined together, the stopper 86 abuts the inner edge surfaces of the side panel 82 and end panel 83, while the side surfaces of the projecting piece 84*a* contact the inner surfaces of the side panel 82 and end panel 83, thereby presenting a continuous structure.

Alternatively, the corner panel 84 may be of an angle or arcuate shape rather than of a trapezoid shape as shown.

Meanwhile, the side panels 82, 82 are so designed as to move back and forth to or from each other, while the end panels 83, 83 may be likewise moved back and forth to or from each other but in the direction perpendicular to that of the side panels 82, 82. The corner panel is located at an angle of 45° to the surfaces of the side panel 82 and end panel 83 and may be moved back and forth along the diagonal line. Thus, the side edge portions of the projecting piece 84*a* of the corner panel 84 extends at an angle of 45° to the surfaces of the side panel 82 and end panel 83 and may be moved back and forth along the diagonal line. Thus, the side edge portions of the projecting piece 84*a* of the corner panel 84 extends at an angle 45° to the surface of the side panel 82 and end panel 83, so that the side edge portions of the projecting piece 84*a* may contact the panels 82, 83 intimately. The bottom panel 85 is coupled through the medium of two columns 87, 87 to the suspension frame 19, the columns 87, 87 being positioned in parallel but mutually spaced relation to each other.

The columns 87, 87 are connected to each other at their upper ends to each other by means of a connecting member 88 made of a H-steel. The connecting member extends slantwise of the steel members of the suspension frame, which steel members extend crosswise of the suspension frame 19, with the ends of the connecting member 88 abutting the undersurface of the suspension frame 19 by means of a connecting bolt 89 affixed to the top of the connecting member 88 in its center vertically.

The connecting bolt 89 extends through a throughhole 90 in the platform 20 and then through a throughhole 92 provided in a reinforcing member 91 made of a channel steel secured to the platform 20 along the connecting member 88. The connecting bolt 89 is formed with a threaded portion 89*a* on its tip portion, and thus the connecting member 88 is tightly fastened to the suspension frame 19 by threading a cap nut 94 having a peaked end on the aforesaid threaded portion 89*a* of the bolt 89 through the medium of a washer 93. It follows from this that the bottom panel 85 is connected through the medium of columns 78 to the suspension frame 19.

On the other hand, side panel 82 and end panel 83 are suspended from the suspension frame 19 in a manner that the panels 82 and 83 may move back and forth, as shown in FIG. 8. The detailed construction is similar to that of the outer mold A.

A pair of rollers 97, 97 are rotatably mounted on bracket 96 which is secured to the upper flanges 82*b*, 83*b* of the side panel 82 and end panel 83 by means of a bolt 95. At least two set of rollers 97 are provided for the side panel 82 and end panel 83, respectively, thus, the inner mold in its entirety is suspended from the suspension frame, while the side panels 82 and end panels 83 may move back and forth, being guided by the I-beam through the medium of rollers 97.

Figure 20:
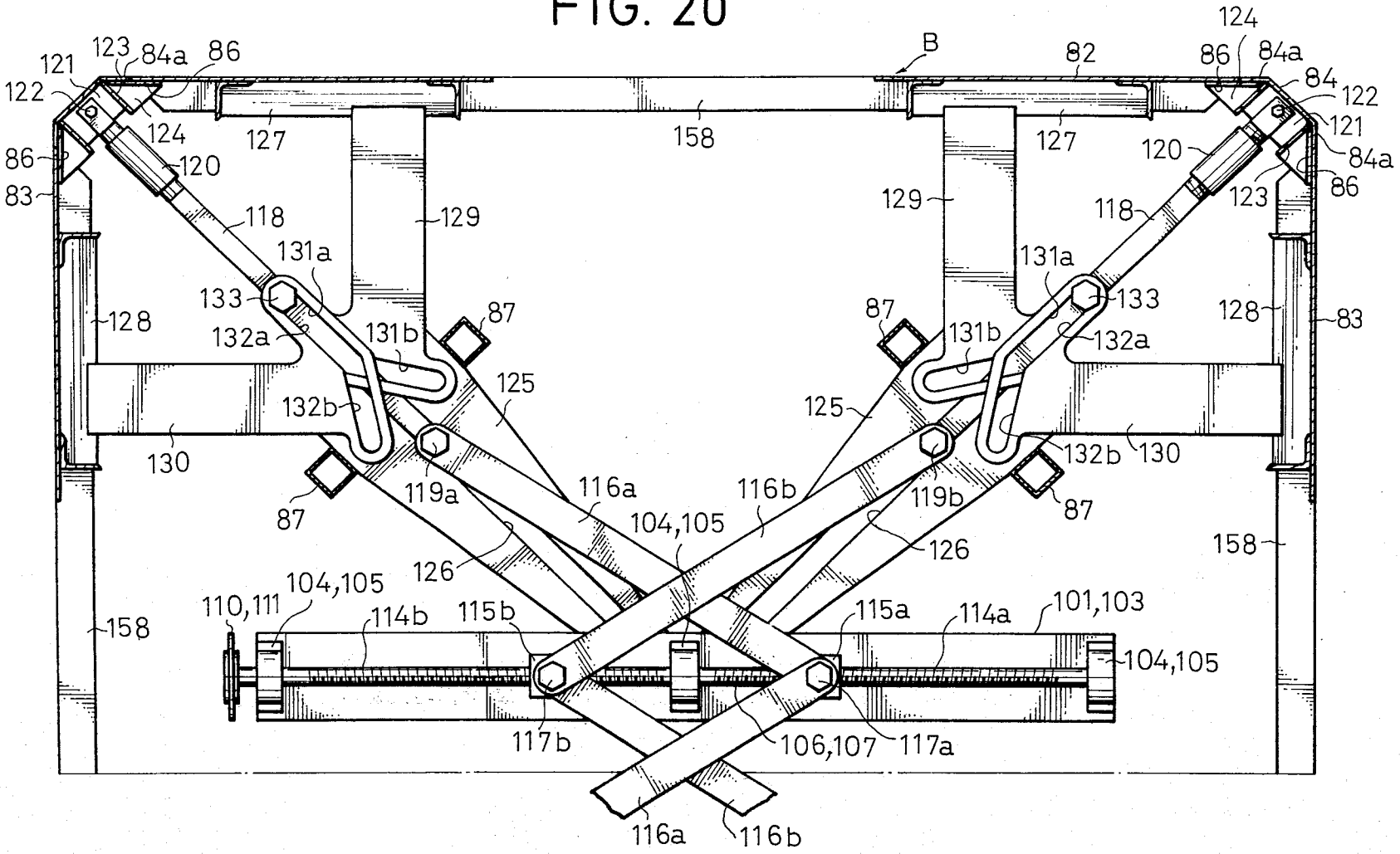
FIG. 20 is an enlarged transverse cross-sectional view of approximately half of an inner mold in its molding position.
Figure 21:
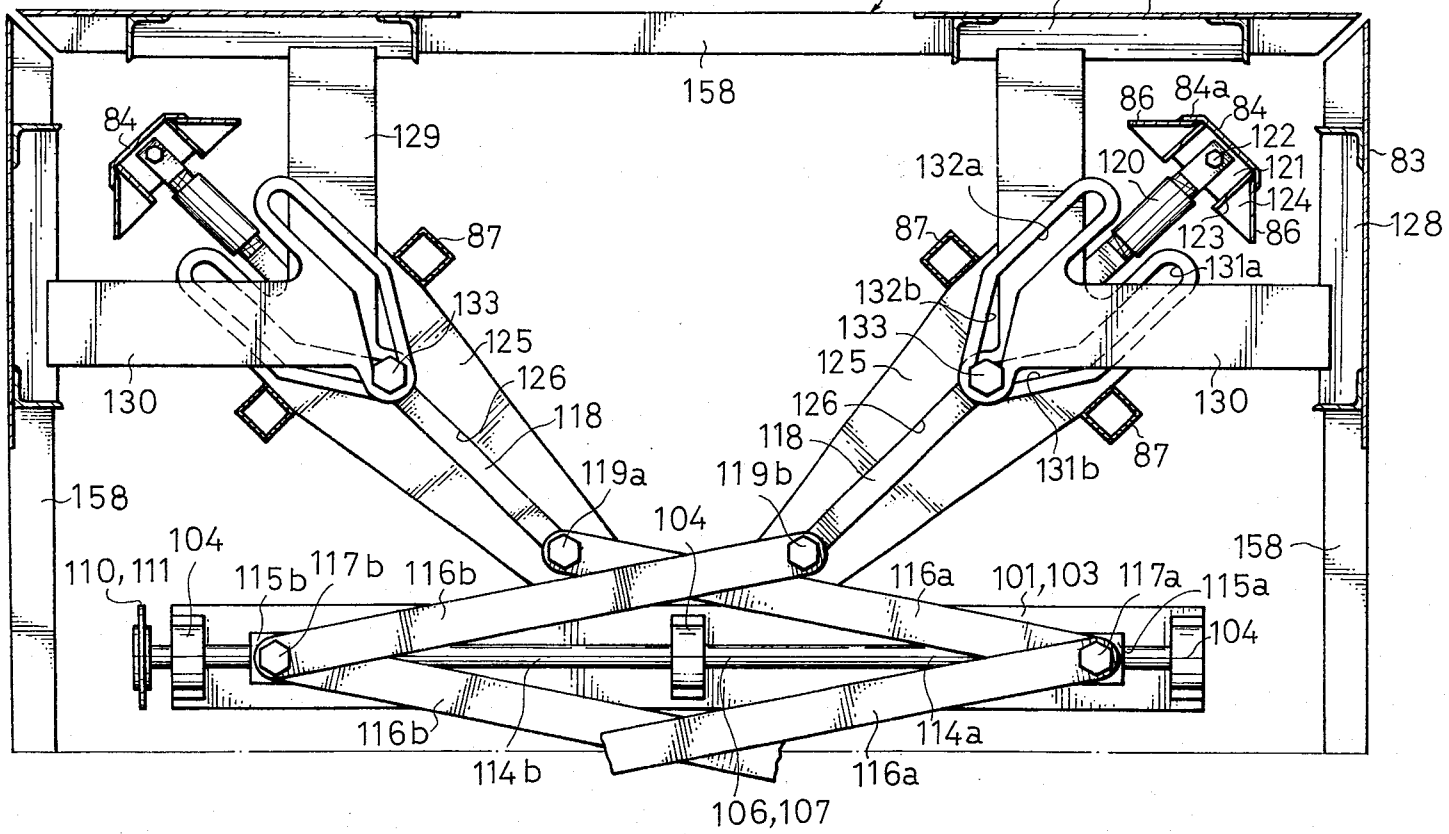
FIG. 21 is an enlarged transverse cross-sectional view of approximately half of an inner mold in the position removed from a mold device.

As shown in FIG. 5, FIG. 20 and FIG 21, an electric motor 98 with a decelerator and the drive mechanism associated threrewith are mounted on the bottom panel 85 for moving the respective side panels 82, end panels 83 and corner panels 84. The motor 98 is rigidly mounted on a transverse member interconnecting the mid portions of two columns 87, 87 which face the end panel 83. Provided above the motor 98 are transverse members 100, 100 interconnecting the columns 87, 87 which face the end panels 83, 83, while a supporting member 101 is secured to the transverse members 100, 100 crosswise. On the other hand, a supporting member 103 is secured to a frame 102 of the bottom panel 85, which frame is located immediately below the supporting member 101. Provided on the upper and lower supporting members 101 and 103 are shafts 106, 107 journaled in bearings 104, 105 at its mid point and the opposite ends thereof.

Chains are trained around sprocket wheels 108, 109 mounted on the rotary shaft of the motor 98 as well as around sprocket wheels 110, 111 mounted on the end portions of shaft 106 and 107, thereby transmitting a drive power to the shafts 106, 107. Since the mechanisms associated with the shafts 106, 107, side panel 82, end panel 83, and corner panel 84 are provided in the upper and lower portions of the mold, having the same construction, so that description will be given only by referring to the associated mechanism with the shaft 106, hereinafter.

The shaft 106 is formed with male thread portions 114*a*, 114*b* which have opposite direction of threads each other and extend from the mid point of the shaft to the opposite ends thereof, with nuts 115*a*, 115*b* threaded on the respective threaded portions 114*a*, 114*b*. Two connecting rods 116*a*, 116*a* are pivotted to the nut 115*a*, and two connecting rods 116*a*, 116*b* are pivotted to the other nut 115*a* by means of pins 117*a*, 117*a*, respectively, in a manner to rotate in the horizontal plane. The connecting rods 116*a*, 116*b* consist of a pair of upper and lower steel strips.

Coupled to and extending from the corner panel 84 are horizontal rods 118 in the same plane with that of the connecting rods 116*a*, 116*b*, with the tip portions of the rods 118 pivotted to the tip portions of the respective connecting rods 116*a*, 116*b* by means of pins 119a, 119b.

The rod 118 is provided with a turnbuckle 120 at the end portions of the rod 118 to thereby adjust the length thereof, while the end portion of the turnbuckle 120 is rigidly secured to a bracket 121 secured to the inner surface of the corner panel 84 by means of a bolt 122. In addition, the plates 123 secured to the opposite sides of the bracket 121 are continuous with stoppers 86 through the medium of reinforcing ribs 124. The rod 118 is fitted in a groove 126 provided in a horizontal guide plate 125 secured to the columns 87, 87 facing the corner panel 84 so that the rod 118 may slide along the groove 126 at an angle of 45° to the side panel 82. The side panel 82 and end panel 83 are provided with horizontal ribs 127, 128 on the inner side edges thereof, on which are mounted horizontal actuating plates 129, 130 consisting of two, upper and lower steel plates and located in the positions corresponding to the horizontal position of the rod 118. The actuating plates 129, 130 are of such an arrangement that the respective upper steel plates overlap above the rod 118, while the respective lower steel plates overlap below the rod 118.

Elongated holes 131*a*, 132*a* of the same configuration are provided in the actuating plates 129, 130 in a manner that the holes 131*a*, 132*a* are in register with each other when the actuating plates 129, 130 overlap in the molding position of side panel 82 and end panel 83, while elongated holes 121*b*, 132*b* are provided in the plates 129, 130 in a manner to be continuous with the elongated holes 131*a*, 132*a* but to extend in the direction slantwise of the holes 131*a*, 132*a* so as to depart from each other as they go towards the tips of the rod. As shown in FIG. 20, a pin 133 pierces through the rod 118 and elongated holes 131*a*, 132*a* on their sides closer to the corner panel 84.

As a result, when the motor 98 is driven and shafts 106, 107 are rotated by means of chains 112, 113 as the same time, then the nuts 115*a*, 115*b* are moved towards the ends of the shafts 106, 107, respectively, whereby the connecting rods 116*a*, 116*b* pull the rod 118 along the groove 126 in the guide plate 125 inwardly of the inner mold B. As a result, the corner panels 84 are detached from the side panel 82 and end panel 83 inwardly of the inner mold B, whereupon the pin 133 slidingly move through the elongated holes 131*a*, 132*a* in the actuating plates 129, 130, while the corner panels 84 only move until the pin 133 reaches the branch pint of the elongated holes 131*b*, 132*b*, thereby leaving a space between the side panel 82 and the end panel 83. When the pin 133 further moves after reaching the branch point, the pin 133 acts so as to bring the elongated holes 131*b*, 132*b* closer to each other to provide partially overlapped portion of the holes, so that the actuating plates 129, 130 are pulled together, wwhereby the side panel 82 and end panel 83 are moved back inwardly of the inner mold B, while maintaining an angular relationship of 90° between the two.

The aforesaid operations are carried out in the four positions both in the upper and lower portions of the mold, i.e., in the eight positions in total, simultaneously, so that the inner mold B in its entirety is detached from the inner surfaces of the concrete block 1 to be collapsed in a manner as shown in FIG. 21.

In case the inner mold is brought from its collapsed condition to its molding position, the motor 98 is driven in the reversed direction so as to rotate the shafts 106 in the reversed direction. Thus, the nuts 115*a*, 115*b* are moved towards to the center of the shafts 106, 107 therealong, thereby pushing the connecting rods 116*a*, 116*b* as well as rod 118 to advance the corner panels 84. With the forward movement of the rod 118, the pin 133 acts so as to bring the elongated holes 131*b*, 132*b* provided in the actuating plates 129, 130 closer to each other, so that the actuating plates 129, 130 are pushed so as to depart from each other, whereby the side panels 82 and end panels 83 are moved outwardly of the inner mold, while maintaining an angular relationship of 90° to each other, and stop in their molding positions, when the pin 133 reaches the branch point of the elongated holes 131*a*, 132*a* and elongated holes 131*b*, 132*b* provided in the actuating plates 129, 130. When the pin 133 further moves after reaching the branch point, the pin 133 may move without any resistance through the elongated holes 131*a*, 132*a* which overlap, while the corner panels 84 moves back to the molding position by the medium of the connecting rods 116*a*, 116*b* and rod 118 to abut the sides of the side panels 82 and end panels 83, thereby assuming molding positions.

Such an operation are carried out in four positions both in the upper and lower portions of the mold, in the eight positions in total, whereby the inner mold B in its entirety may be expanded to the molding position as shown in FIG. 21.

Figure 22:
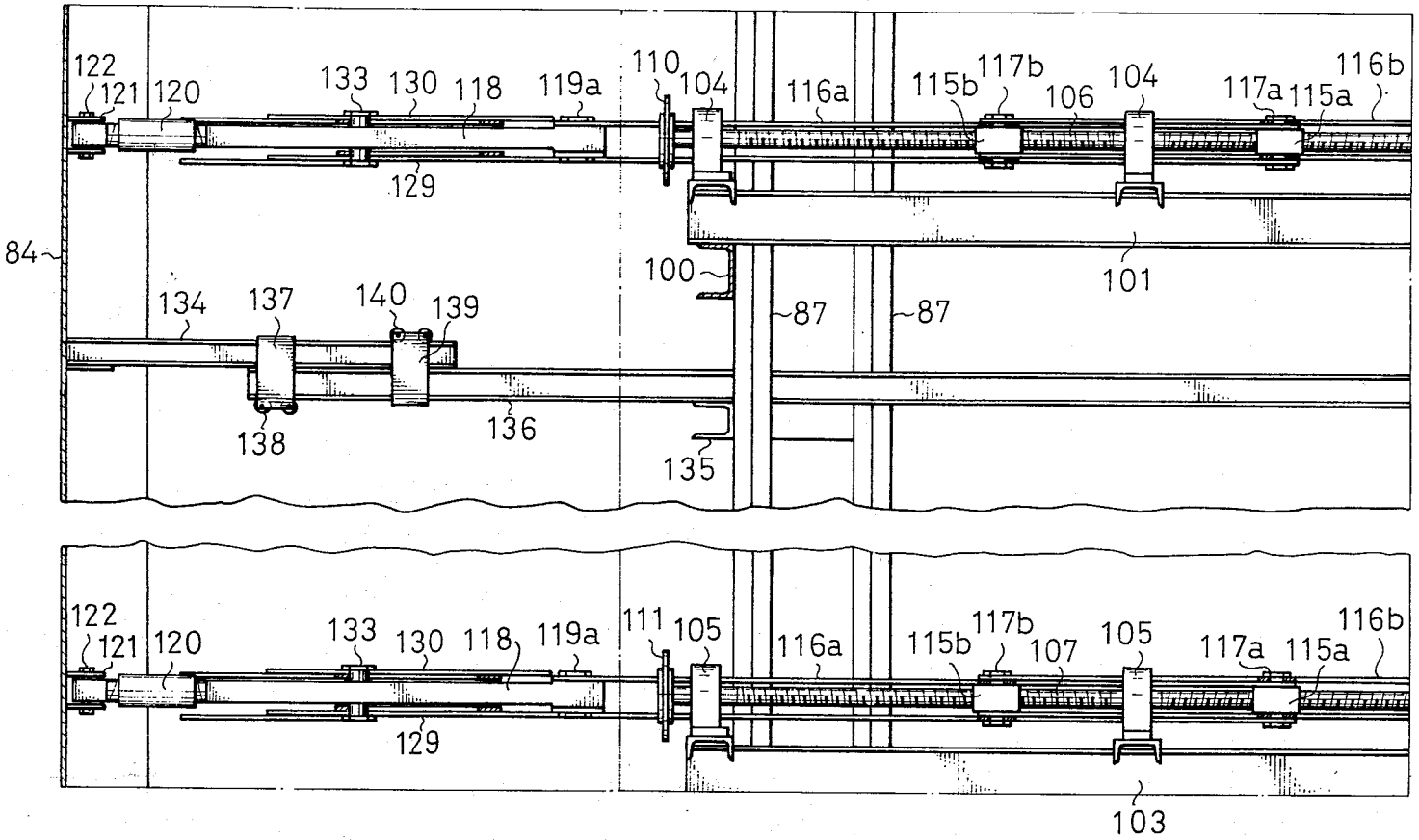
FIG. 22 is a side view showing an actuating mechanism of corner panels in an inner mold in an enlarged relation, omitting an intermediate portion.
Figure 23:
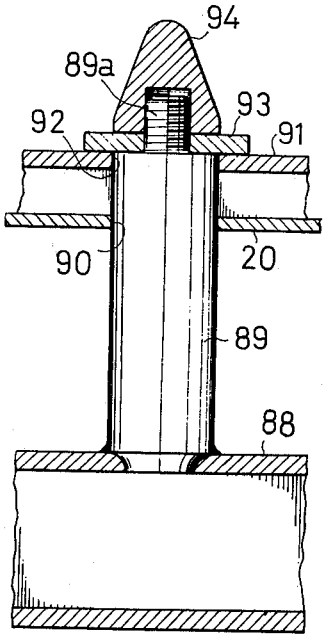
FIG. 23 is a partial longitudinal cross-sectional view of the fastened condition of a connecting bolt for use in connecting a bottom panel to a suspension frame in an inner mold.

FIG. 22 shows the mechanisms associated with the back and forth movements of the corner panels 84 as well as the supporting mechanism of the corner panels 84. Extending from the corner panels 84 is a supporting member 134 which extends in the same horizontal direction as that of the rod 118, while the supporting member 134 is rigidly mounted on the transverse member 13 which interconnects the columns 87, 87, and mounted on the receiving member 136 which projects towards the corner panel 84.

Secured to the supporting member 134 thereon is a bracket 137 whose tips project downwardly along the side surfaces of the supporting member 134, while two sets of rollers 138 (Each set consists of a pair of rollers.) contacting the undersurface of the receiving member 136 are rotatably mounted on the tip portion of the bracket 137. On the other hand, secured to the receiving member 136 thereon is a bracket 139 whose tips project upwardly along the side surfaces of the member 136, while two sets of rollers 140 (Each set consists of a pair of rollers.) are rotatably mounted on the tip portion of the bracket 139.

Accordingly, the supporting member 134 may slidingly move on the receiving member 136, being supported by the receiving member 136, to thereby support the corner plates all the times. The bottom panel 85 is rigidly secured to the undersurface of the frame 102 made of steel members, while peripheral plates 141 are mounted on the bottom plate 85.

The peripheral plates 141 are formed with projecting pieces 142 uprising at a right angle thereto at the tip portion of the plates 141 and has a bracket 143 in the position close to the tail end of the plate 141. The bracket 143 is journaled on a shaft 145 at the lower end of the actuating plate 141 is located between the two guide plates 146, 146 secured to the side surface of the frame 102, while the shaft 147 piercing through the upper portion of the actuating plate 144 is pierced through the vertical elongated hole 148 provided in the guide plate 146, 146. In addition, the shaft has a head portions or retaining member 149 which is located outwardly of the guide plate 146, thereby preventing the shaft 147 from being pulled through the elongated holes 148. Thus, the actuating plate 144 may slidingly move through the elongated holes 148, being guided by the shaft 147 in the vertical direction.

The actuating plate 144 is actuated by means of a hydraulic cylinder 150 provided above the actuating plate 144.

The fluid pressure cylinder 150 is rigidly mounted on a horizontal plate 151 secured to the top surface of the frame 102. The plate 151 is placed on the vertical plate 152 secured to the top surface of the frame 102, while the plates 151, 152 are reinforced with reinforcing plates 153.

The piston rod 154 is pivotted to the shaft 147 of the actuating plate 144 at its tip of the rod 154.

Figure 25:
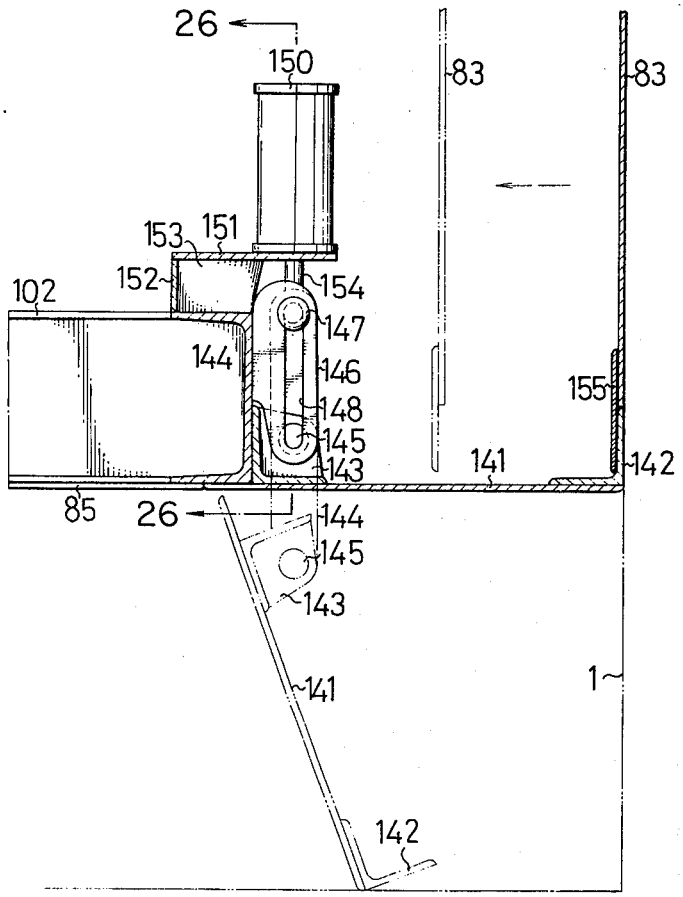
FIG. 25 is a partial longitudinal cross sectional view of a peripheral panels of a bottom panel and its actuating mechanism.
Figure 26:
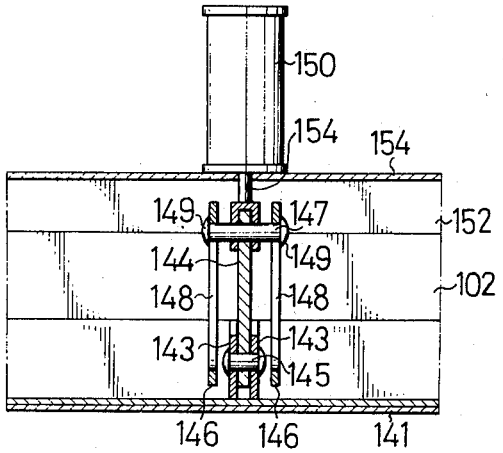
FIG. 26 is a cross-sectional view taken along the line 26—26 of FIG. 25.
Figure 27:
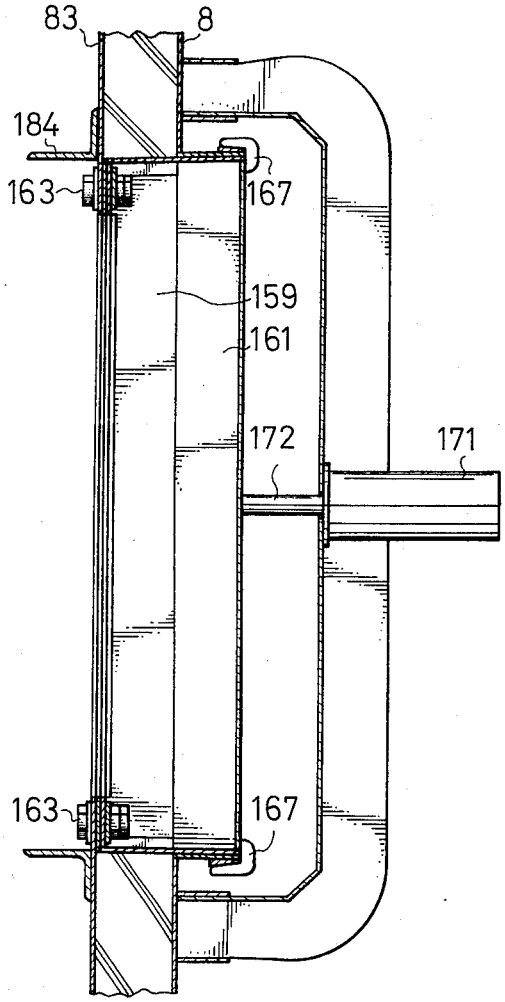
FIG. 27 is an enlarged transverse cross-sectional view of the set condition of a mold for defining an opening in a peripheral panel.

As shown in FIG. 25, the peripheral plate 141 is raised through the medium of the actuating plate 144 by means of fluid pressure cylinder 150 to the horizontal position where the peripheral plate 141 abuts the bottom panel 85. In this condition, molding may be carried out for concrete block 1. As shown, the projecting piece 142 of the peripheral plate 141 abuts the lower edge of the side panel 82 or end panel 83, while a seal plate 155 projecting from the lower end of the side panel 82 or end panel 83, while a seal plate 155 projecting from the lower end of the side panel 82 or end panel 88 overlaps the inner surface of the projecting piece 142, while the rear edge portion of the peripheral plate abuts the peripheral lower surface of the frame 102, and the rear end thereof abuts the edge of the bottom panel 85.

The bottom panel 85 and the peripheral plate 141 are lifted up together with the inner mold A and outer mold A, by slinging the suspension frame 19 after molding of the concrete block 1.

At this time, the side panel 82 of the inner mold B as well as the end panel 83 are in the retracted position from the inner surface of the concrete block 1 as shown by the chain line in FIG. 25. As the bottom panel 82 is lifted up together with the frame 102, when the fluid pressure cylinder 150 is extended to thereby press the peripheral plate 141 through the medium of actuating plate 144, then the peripheral plate 141 remains on the slab of the concrete block 1 for a while, and the rear edge thereof is detached from the undersurface of the frame 102. When the bottom panel 82 is further lifted up, then the rear edge of the peripheral plate 141 is gradually lifted up by means of the actuating plate 144 and then rotates about the shaft 145 downwards as shown by the chain line in FIG. 25 to be laid below the frame 102.

Figure 24:
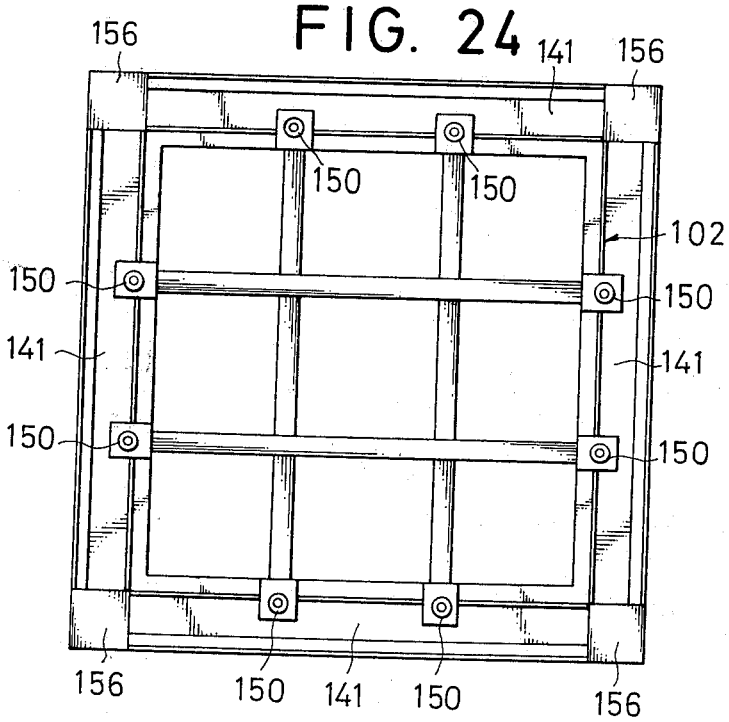
FIG. 24 is a plan view of a bottom panel and a member associated with the bottom panel forming the bottom portion of an inner mold.

Meanwhile, as shown in FIG. 24, the peripheral four sides of the bottom panel 85 are not completely encompassed with the peripheral plates 141. However, the portion which is not encompassed with the peripheral plate 141 is covered with a cover plate 156 which is removably provided, before placing concrete into molds, and then the cover plate 141 is removed after molding.

The assembling operations of the outer mold A and inner mold B or dismantling operations may be carried out in cooperation with each other in a known manner.

For instance, a control mechanism to this end may be such that the motor of the inner mold B and the fluid pressure cylinder 10 of the outer mold A are electrically connected through a single switch.

Description will now be given of the mold C for defining openings 2 in the concrete block 1, as shown in FIGS. 27 and 28 through 33. The molds C are provided for the openings which are required for the concrete block 1, and thus the molds C are not required, if such openings are not necessary for the concrete block.

As shown in FIG. 1, there is provided an opening 2 either in the side wall 1*a* or in the end wall 1*c* in the concrete block 1. As has been described, the mold C is used for defining the opening 2. For simplicity of the description, the molding of opening 2 in the end wall 1*c* will be referred to hereinafter.

An opening portion 157 is provided in the end panel 8 of the outer mold A, commensurate with the position and dimensions of the opening 2 in the concrete block 1. On the other hand, an opening portion 158 having a size slightly smaller than that of the opening portion 157 is provided in the end panel 83 of the inner mold. In the molding positions of the outer mold A and inner mold B, a mold 159 is fitted in the opening portion 157 in the end panel 8, with the front surface of the mold 159 intimately contacts the periphery of the opening portion 158 in the end panel 83.

The mold for defining an opening in the wall of a concrete block, i.e., opening mold 159 is a hollow steel frame, having a flange 160 along the periphery of the front surface thereof and horizontal ledges 161 therein, which are positioned in the upper and lower portions thereof and made of steel channels. Secured to the inner surface of the flange 160 is a reinforcing plate 162, while there are provided a plurality of tightening bolts 164 at a given spacing in the outer surface of the flange 160. The bolts 164 have retaining portions 162 of square, circular or other shape. The tightening bolt 164 extends through the flange 160 and reinforcing plate 162, with the end portion being threaded into the nut 165 secured to the reinforcing plate 162 and further tightened with a nut 166. Thus, the length of the bolt 146 projecting from the flange 160 is adjusted by adjusting the extent of the nuts 165, 166 threaded on the end portion of the bolt 146. Secured to the inner surface of the opening mold 159 are a plurality of hook pieces 167 having hooked tips which project outwardly from the opening mold 159, with a small clearance defined between the hooked tips and the outer edge of the mold 159.

Meanwhile, it is preferable that the opening mold 159 be tapered so as to give a divergent peripheral surface from the front edge to the rear.

Provided on the periphery of the opening portion 157 of the end panel 8 but projecting therefrom is a guide frame 168 for guiding the opening mold 159, while wedges 159 are secured to the outer periphery of the guide frame 168 for tightly fastening the opening mold 159 to the guide frame 168, by being fitted in a gap defined between the hooked portion of the hook pieces 167 and the opening mold 159, when the opening mold is fitted in position.

Provided on the outer surface of the end panel 8 of the outer mold A is a channel type frame 170 which is secured to the end panel 8 at the opposite edges of the frame 170 spanning the opening portion 157 horizontally, while the position of the frame 170 corresponds to that of the horizontal ledges 161 of the opening mold 159. Rigidly mounted in the center of the frame 170 is a hydraulic cylinder 171. A piston rod 172 of the hydraulic cylinder 171 extends through the frame 170, having its tip portion secured to the horizontal ledge 161. As a result, the opening mold 159 may be moved back and forth through the opening portion 157 in the end panel 8 due to the actuation of the fluid pressure cylinder 171.

Secured to the outer peripheral surface of the opening portion 158 of the end panel 83 in the inner mold B is a reinforcing plate 173. Provided in the end panel 83 and the reinforcing plate 173 are a plurality of through-holes 174 which permit the passage of the retaining portions 163 of the tightening bolts 164, but in the positions corresponding to those of the tightening bolts 164 projecting from the flange 160 of the opening mold 159. In addition, slidable in the opposing direction on the inner peripheral surface of the opening portion 158 are a pair of fastening bodies 175, 176 which are located in the upper and lower positions thereof.

The fastening bodies 175, 176 consist of horizontal plates 175*a*, 176*a* and vertical plates 175*b*, 176*b* which are perpendicular to the horizontal plates, thus providing a channel shape. Thus, the size of the frame consisting of the actuating plates 157 and 158 is such as to encompass the periphery of the opening portion 158 of the end panel 83. On the other hand, there are provided through-holes 177, 178 in the horizontal plates 175*a*, 176*a* and vertical plates 175*b*, 176*b*, respectively, but in the positions corresponding to those of the through-holes 174 provided in the periphery of the opening portion 158. Continuous with the through-holes 177, 178 are elongated holes 179, 180 which extend in the opposing direction of the fastening bodies 175, 176, while the widths of the elongated holes 179, 180 are such dimensions corresponding to the diameter of the tightening bolt 164.

Secured to the fastening bodies 175, 176 are substantially 'U' shaped wedges 181, 182 which encompass the respective elongated holes 179, 180 inwardly of the inner mold.

The wedges 181, 182 having thicknesses which are increasing from their open end to their rear end, with the open end directed towards the through-holes 177, 178. The actuating bodies 175, 176 are placed around the periphery of the opening portion 158, with the vertical plates 175*b*, 176*b* in opposing relation, and slidably supported by the guide member 184 made of an angle steel secured to the side edge of the opening portion 158 of the end panel 83 as well as by the supporting member 185.

There are provided two fluid pressure cylinders 186 for moving the fastening members 175, 176 in the opposing direction to each other. The fluid pressure cylinder 186 has a bracket 187 which is located on its root portion, and the bracket 187 is secured to the bracket 188 provided on the edge portion of the vertical plate 175*b* of the fastening member 175, while the piston rod 189 is secured to a bracket 190 provided on the edge portion of the vertical plate 176*b* of the other fastening member 176.

As a result, when the opening mold 159 is fitted in position, with the fluid pressure cylinder 186 compressed and with the fastening members 175, 176 brought close to each other through the medium of the stopper 183, then the respective tightening bolts 164 pass through the through-hole 174 on the periphery of the opening portion 158 of the end panel 83 and through the through-hole 177, 178 in the fastening members 175, 176, then project into the inner mold B.

Figure 28:
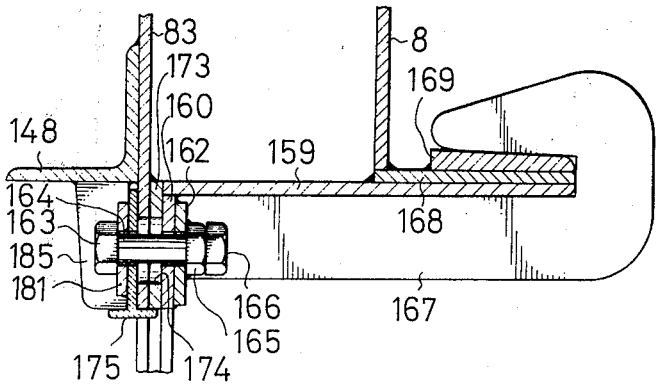
FIG. 28 is a partial enlarged transverse cross-sectional view of a fastened condition of a mold for defining an opening in a peripheral panel.
Figure 29:
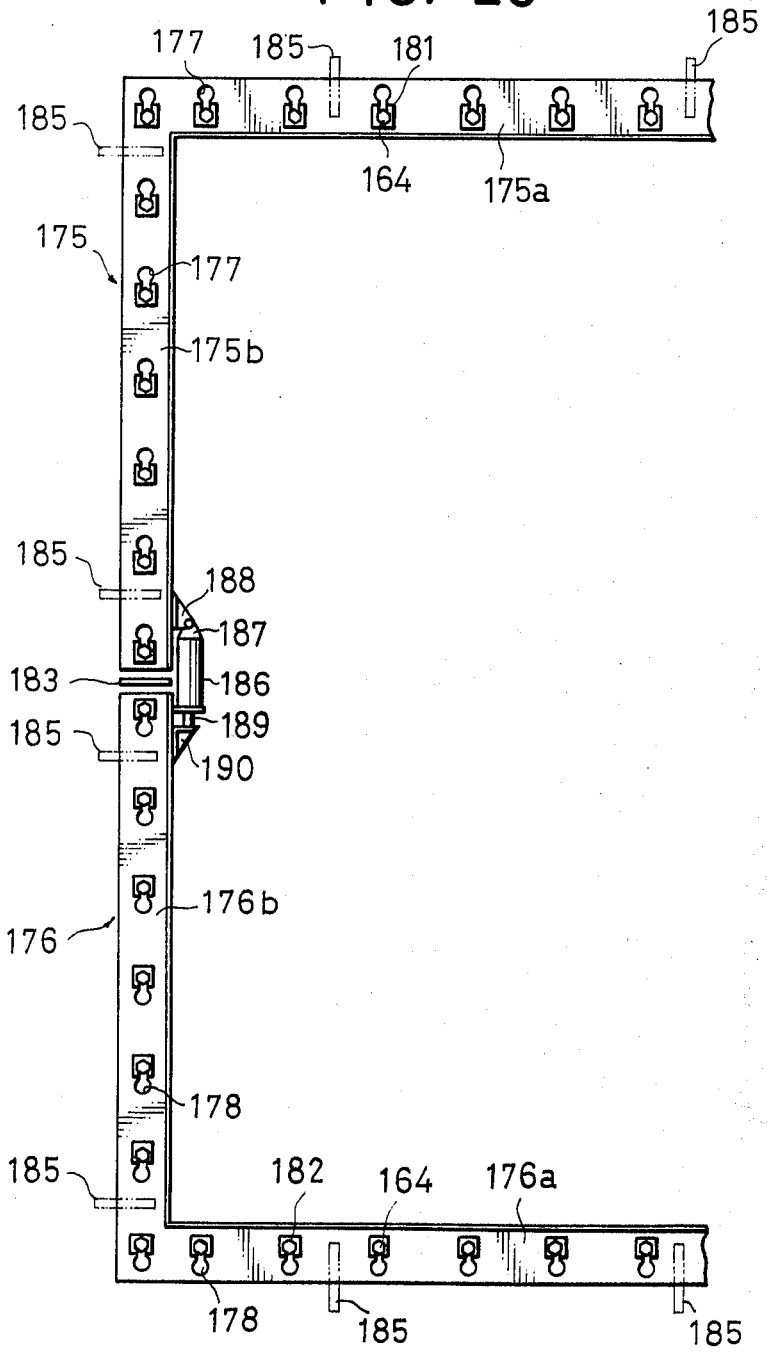
FIG. 29 is a front view showing approximately half part of a actuating member for fastening the mold for defining an opening to an end panel in an inner mold.
Figure 30:
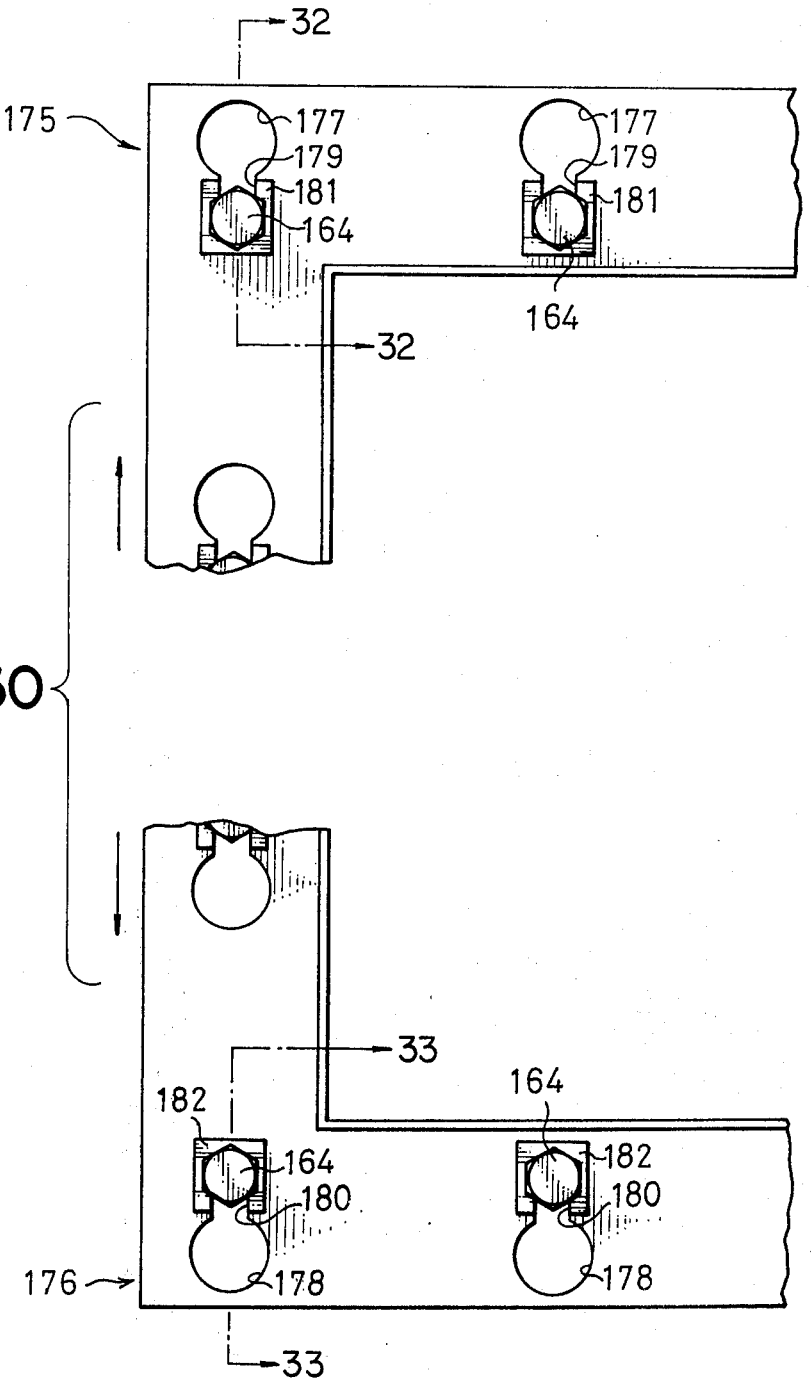
FIG. 30 is a partial front view of a actuating member, showing a fastening bolt of the mold for defining an opening.

Under these condition, when the hydraulic cylinder 186 is extended so as to cause the fastening members 175, 176 to slidingly depart from each other, then the wedges 181, 182 make ingress under the undersurfaces of the retaining portions 163 of the tightening bolts 164 which project downwardly through the through-holes 177, 178, thereby fastening the flange 160 of the opening mold 159 to the end panel. FIG. 28 shows such a fastened condition.

Subsequently, when the opening mold 159 is withdrawn from the concrete block 1 thus molded, the fluid pressure cylinder 186 is compressed so as to cause the fastening members 185, 186 to slide closer to each other, then the wedges 181, 182 will be detached from the tightening bolt 164, and then the edge portions of the vertical plates 15*b*, 176*b* abut the stopper 183 to stop thereat, whereupon the tightening bolt 164 will be housed in the through-holes 177, 178.

Figure 31:
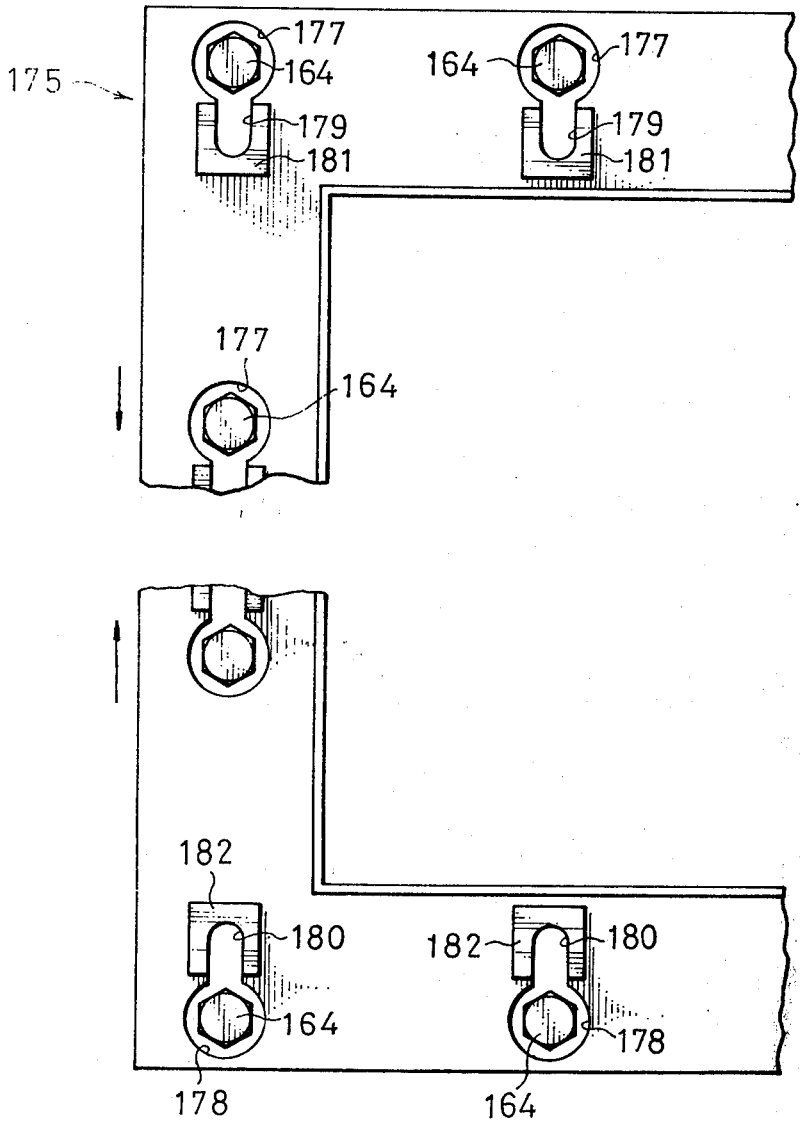
FIG. 31 is a partial front view of a actuating member, showing a fastening bolt of the mold for defining an opening in its released position.
Figure 32:
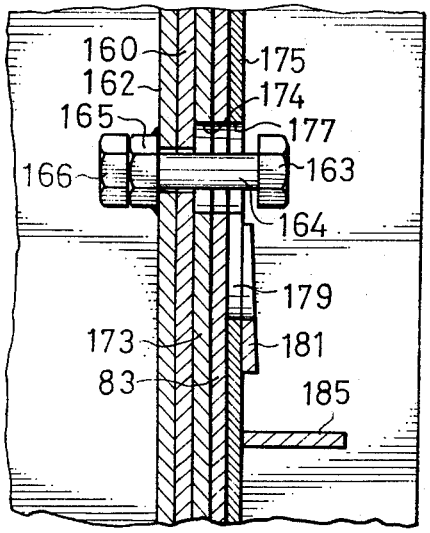
FIG. 32 is a cross-sectional view taken along the line 32—32 of FIG. 30.
Figure 33:
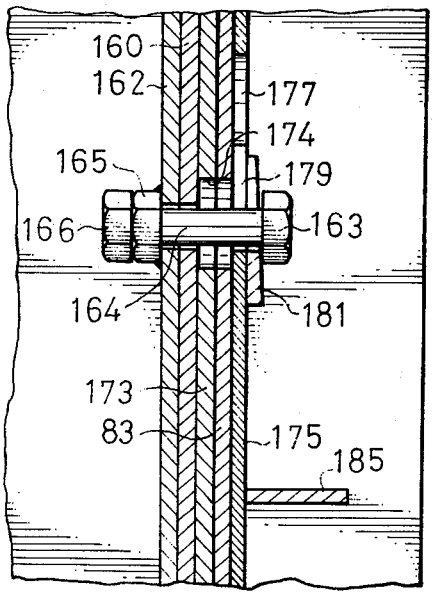
FIG. 33 is a cross-sectional view taken along the line 33—33 of FIG. 30.

FIG. 31 shows this condition. In addition, when the hydraulic cylinder 171 is compressed, then the opening mold 159 is detached from the end panel 82 as well as from the concrete block 1, whereby opening 2 is defined.

Figure 34:
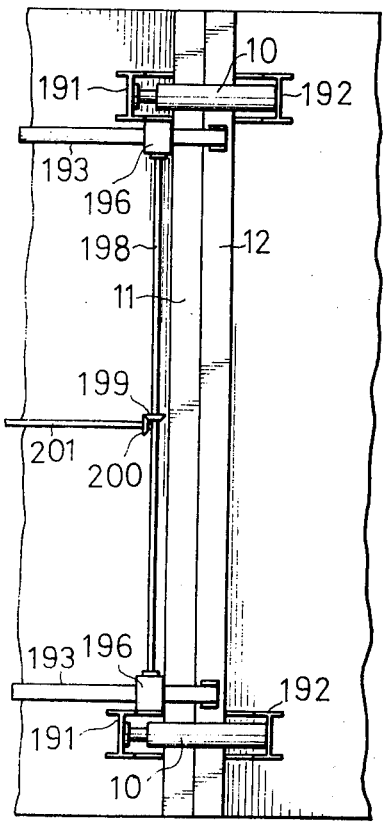
FIG. 34 is a transverse cross-sectional view of the corner portions of the outer mold using a cylinder haivng a relatively long stroke, the outer mold being on its molding position.
Figure 35:
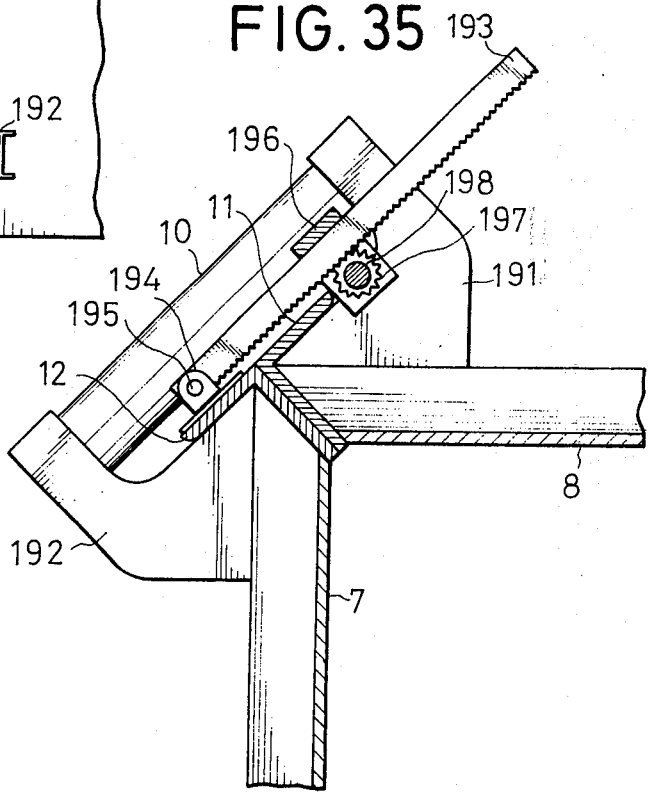
FIG. 35 is a front view of a corner portion of the outer mold using a cylinder having a relatively long stroke, the outer mold being in its molding position.

FIG. 34 and 35 show the arrangement, in which there is provided a cylinder 10 having a relatively long stroke for the purpose of removing the opening mold 159 without moving same back and forth, i.e., with the opening mold 159 being integral with the side panel 7 and end panel 8 in the outer mold A. The cylinder is mounted on arms 191, 192 projecting from the side panel 7 and end panel 8. Such a cylinder is provided for each corner and at least two positions, i.e., in the upper and lower ends of the panels, respectively.

Pivotted to a bracket 194 on arm 192 by means of a pin 195 is a rod 193 having a rack on one side thereof. The rod 193 is located in the portion close to the cylinder 10, and the rack extends in parallel with the cylinder 10. Furthermore, the rod 193 is slidingly extends through a channel type bracket 196 attached to the other arm 191 and meshes with pinion gear 197 supported by the upper and lower opposing pieces of the bracket 196. The upper and lower pinion gears 197 are connected by means of a shaft 198.

Accordingly, even if there is timing difference in the actuation between the upper and lower cylinders 10, the rod 193 meshing with the pinion gears 197 may be moved at the same time, so that the synchronous back and forth movement of the side panel 7 and end panel 8 may be effected with respect to the upper and lower sides of panels. This eliminates the possibility of the unbalanced movements of the outer mold with respect to the upper and lower sides of the panels of the panels.

Figure 36:
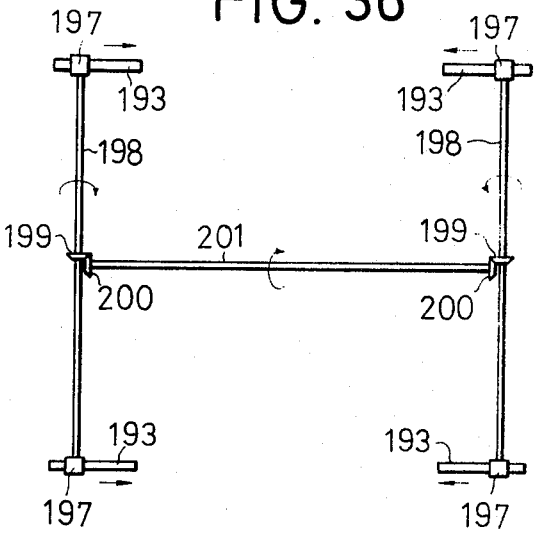
FIG. 36 is an outline showing the connected condition of the adjoining shafts by means of a gear mechanism in the outer mold, the shafts having pinion gears in the upper and lower ends thereof.

FIG. 36 shows that bevel gears 199 are mounted on the shafts 198 located on the respective corners of the outer mold A while four shafts 198 are connected by means of a horizontal rod 201 having bevel gears 200 attached to the opposite ends thereof, so that the respective shafts 198 may be rotated in synchronous timing, to thereby move the side panels 7 and end panels 8 in the synchronous timing, with respect to the upper and lower sides of the panels.

According to the cylinder 10 having a relatively long stroke, a large spacing between the side panels 7, 82 and the end panels 8, 83 may be obtained in the removing positions of the outer mold A and inner mold B, so that the opening mold 159 may be removed in the integral relation to the side panel 7 and end panel 8. In addition, an operator may go between the outer mold A and inner mold B for cleaning. Still furthermore, a cage ingergally assembled beforehand can be positioned into the mold for forming the concrete block.

With the aforesaid arrangement, when molding the concrete block 1, cap nut 94 and washer 93 are removed from the connecting bolt 89 which fastens the suspension frame 19 to the connecting member 88, followed by the attaching bolt 85 of the bracket 96 mounting rollers 97 thereon. Thus, the suspension frame 19 is detached from the inner mold B, so that the inner mold is placed on a suitable spacer (not shown) on the bottom panel 9 of the outer mold A, and then suspension frame 19 is slung up together with the side panel 7 and end panel 8 of the outer mold A by means of a suitable hoisting means.

Then, reinforcing steels (not shown) are placed around the periphery of the inner mold B thus left alone, and then the outer mold A is lowered, being guided by the guide pin, to be mounted on the base support 28. In this respect, if a cap nut 94 is threaded on the connecting bolt 89 beforehand, then the cap nut may function as a guide pin, whereby the connecting bolt 89 is smoothly fitted into the through-holes 90 and 92 provided in the platform 20 of the suspension frame and the reinforcing member 91, thereby accurately guiding the suspension frame 19.

Then, the washer 93 is fitted on the connecting bolt 89 and then the cap nut 94 is threaded on the bolt 89 to thereby fasten the suspension frame 19 to the connecting member 88, while the bracket 96 is fastened to the flange 82*a* of the side panel 82 as well as to the flange 83*a* of the end panel 83 by means of a bolt 95.

Next, hydraulic cylinders 72, 73 are actuated to thereby fasten the flanges 7*b*, 8*b* of the side panel 7 and end panel 8 in the outer mold A to the base support 28 through the medium of the fastening plates 57*a*, 57*b*, and 59*a*, 59*b*.

Furthermore, the motor 98 is actuated to advance the side panel 82, end panel 83 and corner panel 84 to the molding position.

After the assembly of the outer mold A and inner mold B, if required, the opening mold 159 is set, then concrete is placed or poured through the inlet 27 in the upper conver 26 into the outer mold A and inner mold B.

For removing the molds from the concrete block after the concrete has been cured, then the fluid pressure cylinders 72, 73 and 36, 47 are actuated to release the flange 7*b*, 8*b* of the side panel 7 and end panel 8 in the outer mold A from the base support 28. Under this condition, the outer mold A is extended under the action of the fluid pressure cylinder 10, and the inner mold B is collapsed due to the drive of the motor 98, thereby removing the side panels 7, 82 end panels 8, 83 and corner panel 84 from the concrete block 1 thus molded, or if necessary, the opening molds are withdrawn from the concrete block 1.

Then, the suspension frame 19 is slung up by means of a hoisting means together with the outer mold A and inner mold B, thereby leaving the concrete block alone thereat.

Thereafter, the concrete block 1 is delivered to a distination, and the similar operational cycle is repeated as required.

While description has been given of the outer mold A and inner mold B by referring to the accompanying drawings, wherein the widths of the respective side panel and end panels are equal with the resulting cubic concrete block 1, it should be understood that the present invention is by no means limited to those embodiments, but a rectangular parallelopiped body may be produced, having side panels wider than the end panels. In this case, there may be insured an adequate stroke for moving back and forth the corner panels 84 in the inner mold B, so that the connecting rods 116*a*, 116*b* pivotted to the nuts 115*a*, 115*b* of the shafts 106, 107 may be pivotted to the rod 118 of the corner panel 84 without intersecting the connecting rods 116*a*, 116*b* with each other. It is needless to mention that the associated arrangement such as suspension frames and columns 87 may be varied, commensurate with the design.

In addition, the arrangement of the motor 98 in the inner mold B as well as shafts 106, 107 rotated thereby should not necessarily be limited to the arrangement of the transverse members 99, 100 coupled to the column 87. Thus, the transverse members may be secured to the frame 102 of the bottom panel 85, independently of the column 87. Furthermore, the position of means for transmitting the rotating force from the motor 98 to the shafts 106, 107 may be varied, and the sprocket chain should not necessarily be used.

I claim:

1. A molding device for producing a box-type concrete block, comprising:

an outer mold including bottom panel means, a pair of opposed parallel side panels, and a pair of opposed parallel end panels at right angles to said side panels;

an inner mold including bottom panel means spaced above said bottom panel means of said outer mold, a pair of side panels each spaced inwardly from and parallel to one of said side panels of said outer mold, a pair of end panels each spaced inwardly from and parallel to one of said side panels of said outer mold, and corner panel means between adjacent ones of said side and end panels of said inner mold; and support means for said outer and inner molds including means supporting saids bottom panel means of said outer mold and suspension frame means supporting said bottom panel means of said inner mold, said suspension frame means further supporting each said side and end panels of said outer and inner molds for horizontal linear movement inwardly and outwardly relative to the corresponding bottom panel means, and said suspension frame means supporting each of said corner panel means independent of the side and end panels for horizontal movement toward and away from the corresponding ones of said adjacent side and end panels along a linear path generally bisecting the corner between said corresponding ones of said adjacent side and end panels.

2. The molding device as set forth in claim 1, and fluid pressure cylinder means at the corners between adjacent ones of said side and end panels of said outer mold and disposed at an angle of 45° to the latter said adjacent panels, said cylinder means including at least one cylinder at each corner affixed to one of said latter said adjacent panels and having a piston rod, said piston rod having an outer end affixed to the other of said latter said adjacent panels.

3. The molding device as set forth in claim 2, wherein said adjacent ones of said side and end panels of said outer mold have side edges, a frame member mounted on each of said side edges and extending perpendicular to the longitudinal axis of said one cylinder and its piston rod, said cylinder being affixed to one of said frame members and said outer end of said piston rod to the other frame member.

4. The molding device as set forth in claim 1 wherein said support means includes a supporting base for said inner and outer molds, said bottom panel means of said outer mold including metal plate means affixed to said supporting base.

5. The molding device as set forth in claim 1, and operating means supported by said suspension frame means and operable to displace each said corner panel means toward and away from the corresponding ones of said adjacent side and end panels, said operating means including a pair of spaced apart parallel rods extending inwardly of said inner mold from each said corner panel means at an angle of 45° to said adjacent side and end panels, each rod having an inner end, drive means including reciprocable drive member means within said inner mold, connecting link means having opposite ends pivotally connected one to the inner end of each said rod and the other to said drive member means, and means to guide movement of said rod along a linear path at said angle in response to reciprocation of said drive member means.

6. The molding device as set forth in claim 5, wherein the length of each of said rods is adjustable.

7. The molding device as set forth in claim 6, wherein said guide means includes a plate for each rod and supported by said suspension frame means, said plate having a guide groove slidably receiving the corresponding rod.

8. The molding device as set forth in claim 5, wherein said drive means includes threaded shaft means rotatably supported by said suspension frame means and said reciprocable drive member means includes internally threaded rider means on said shaft means movable therealong in response to shaft rotation.

9. The molding device as set forth in claim 1, wherein said suspension frame means includes beams overlying and extending outwardly beyond each side panel and end panel of said inner and outer molds, and means slidably mounting said side and end panels on corresponding ones of said beams.

10. The molding device as set forth in claim 9, wherein said means slidably mounting said panels includes roller means attached to each panel and in rolling engagement with corresponding ones of said beams.

11. The molding device as set forth in claim 10, wherein said roller means includes rollers and brackets supporting said rollers, said brackets each being attached to a corresponding one of said side and end panels and removably attached to at least the side and end panels of said inner mold.

12. The molding device as set forth in claim 1, wherein at least one pair of corresponding ones of said side panels and end panels of said inner and outer molds are provided with openings therethrough, and mold frame means in said openings and spanning the space therebetween.

13. The molding device as set forth in claim 12, wherein said mold frame means are supported on the panel of the outer mold for movement in opposite directions axially of said openings.

14. The molding device as set forth in claim 12, and guide frame means for guiding said mold frame means, said guide frame means including flange means extending about the opening through the panel of the outer mold and projecting outwardly from said panel, hook members secured to said mold frame means and including portions spaced from said mold frame means to define recesses therewith opening towards and receiving said flange means.

15. A molding device for producing a box-type concrete block, comprising:

an outer mold including bottom panel means, a pair of opposed parallel side panels, and a pair of opposed parallel end panels at right angles to said side panels;

an inner mold including bottom panel means spaced above said bottom panel means of said outer mold, a pair of side panels each spaced inwardly from and parallel to one of said side panels of said outer mold, a pair of end panels each spaced inwardly from and parallel to one of said side panels of said outer mold, and corner panel means between adjacent ones of said side and end panels of said inner mold;

support means for said outer and inner molds including means supporting said bottom panel means of said outer mold and suspension frame means supporting said bottom panel means of said inner mold, said suspension frame means further supporting each said side and end panels of said outer and inner molds for movement inwardly and outwardly relative to the corresponding bottom panel means and supporting each of said corner panel means for movement toward and away from the corresponding ones of said adjacent side and end panels; and fluid pressure cylinder means at the corners between adjacent ones of said side and end panels of said outer mold and disposed at an angle of 45° to the latter said adjacent panels, said cylinder means including one cylinder at each corner affixed to one of said latter said adjacent panels and having a piston rod, said piston rod having an outer end affixed to the other of said latter said adjacent panels, said cylinder means including a second cylinder and piston rod at each corner spaced from and parallel to said one cylinder at the corresponding corner, a toothed slide rod parallel to each cylinder and having an end attached to said one of said latter said adjacent panels, a pinion for each said rod and mounted on said other of said latter said adjacent panels in meshing engagement with the corresponding toothed slide rod, and shaft means interconnecting the two pinions at each corner for rotation together.

16. The molding device as set forth in claim 15, wherein at least one pair of said shaft means at adjacent ones sof said corners are interconnected by shaft and gear means therebetween for rotation together.

17. A molding device for producing a box-type concrete block, comprising:

an outer mold including bottom panel means, a pair of opposed parallel side panels, and a pair of opposed parallel end panels at right angles to said side panels;

an inner mold including bottom panel means spaced above said bottom panel means of said outer mold, a pair of side panels each spaced inwardly from and parallel to one of said side panels of said outer mold, a pair of end panels each spaced inwardly from and parallel to one of said side panels of said outer mold, and corner panel means between adjacent ones of said side and end panels of said inner mold; and support means for said outer and inner molds including means supporting said bottom panel means fo said outer mold and suspension frame means supporting said bottom panel means of said inner mold, said suspension frame means further supporting each said side and end panels of said outer and inner molds for movement inwardly and outwardly relative to the corresponding bottom panel means and supporting each of said corner panel means for movement toward and away from the corresponding ones of said adjacent side and end panels, said means supporting said bottom panel means of said outer mold including supporting base means, said side and end panels of said outer mold having lower ends including flange means overlying said base means, said base means and flange means having aligned openings therethrough, bolts on each said side and end panels of said outer mold, means supporting said bolts for reciprocating movement axially of said openings and between extended and retracted positions relative to said openings, said bolts having heads spaced below the openings in said base means when said bolts are in the extended position, and means on said base means displaceable to interengage said bolt heads against movement of said bolts from the extended to the retracted positions thereof.

18. The molding device as set forth in claim 17, wherein said means supporting said bolts includes fluid pressure operable piston and cylinder means mounted on each said side and end panels of said outer mold.

19. The molding device set forth in claim 18 wherein each said piston and cylinder means includes a cylinder mounted on the corresponding one of said side and end panels of said outer mold and a piston rod extending axially of the corresponding ones of said openings and having an outer end, support plate means affixed to the outer end of said piston rod and extending transverse to the axes of said corresponding openings, said bolts having ends spaced from said heads and interconnected with said support plate means.

20. The molding device as set forth in claim 19, wherein said ends of said bolts are interconnected with said support plate means for axial adjustment of said bolts relative thereto.

21. The molding device as set forth in claim 17, wherein said displaceable means on said base means includes actuating plate means slidable relative to said base means between engaging and releasing positions, said actuating plate means including openings having a first portion of a size which permits the passage of said bolt heads therethrough and a second portion continuous with said first portion and of a size substantially the same as the diameters of said bolts, and wedges on said actuating plate means adjacent said second portions of said openings, the thickness of said wedges increasing in the direction from the ends of said second portions communicating with said first portions, said wedges engaging said bolt heads when said actuating plate means is in said engaging positions.

22. The molding device as set forth in claim 21, wherein said actuating plate means includes a pair of aligned actuating plate members having opposed adjacent inner ends, and fluid operated piston and cylinder means interconnecting said adjacent inner ends and including a cylinder mounted on one of said actuating plate members and a piston rod having an outer end attached to the other of said plate members.

23. The molding device as set forth in claim 22, wherein said base means includes guide means slidably supporting said actuating plate members.

24. The mold device as set forth in claim 23 wherein said guide means includes a plurality of parallel spaced apart guide plates each having a recess receiving and slidably supporting a corresponding one of said actuating plate members.

25. A molding device for producing a box-type concrete block, comprising:

an outer mold including bottom panel means, a pair of opposed parallel side panels, and a pair of opposed parallel end panels at right angles to said side panels;

an inner mold including bottom panel means spaced above said bottom panel means of said outer mold, a pair of side panels each spaced inwardly from and parallel to one of said side panels of said outer mold, a pair of end panels each spaced inwardly from and parallel to one of said side panels of said outer mold, and corner panel means between adjacent ones of said side and end panels of said inner mold;

support means for said outer and inner molds including means supporting said bottom panel means of said outer mold and suspension frame means supporting said bottom panel means of said inner mold, said suspension frame means further supporting each said side and end panels of said outer and inner molds for movement inwardly and outwardly relative to the corresponding bottom panel means and supporting each of said corner panel means for movement toward and away from the corresponding ones of said adjacent side and end panels;

operating means supported by said suspension frame means and operable to displace each said corner panel means toward and away from the corresponding ones of said adjacent side and end panels, said operating means including a pair of spaced apart parallel rods extending inwardly of said inner mold from each said corner panel means at an angle of 45° to said adjacent side and end panels, each rod having an inner end, drive means including reciprocable drive member means within said inner mold, connecting link means having opposite ends pivotally connected one to the inner end of each said rod and the other to said drive means, and means to guide movement of said rod along a linear path at said angle in response to reciprocation of said drive member means, the length of each of said rods being adjustable; and actuating plates mounted on and extending inwardly of said inner mold from each said corresponding side and end panels, said actuating plates having overlapping inner end portions overlying a corresponding one of said corner panel rods, said overlapping portions of said actuating plates having slots therethrough, pin means extending through said slots and affixed to said corresponding corner panel rod, said slots and pin interengaging in response to movement of said corner panel rod to displace said corresponding side and end panels inwardly and outwardly perpendicular to the respective planes thereof.

26. A molding device for producing a box-type concrete block, comprising:

an outer mold including bottom panel means, a pair of opposed parallel side panels, and a pair of opposed parallel end panels at right angles to said side panels;

an inner mold including bottom panel means spaced above said bottom panel means of said outer mold, a pair of side panels each spaced inwardly from and parallel to one of said side panels of said outer mold, a pair of end panels each spaced inwardly from and parallel to one of said side panels of said outer mold, and corner panel means between adjacent ones of said side and end panels of said inner mold; and support means for said outer and inner molds including means supporting said bottom panel means of said outer mold and suspension frame means supporting said bottom panel means of said inner mold, said suspension frame means further supporting each said side and end panels of said outer and inner molds for movement inwardly and outwardly relative to the corresponding bottom panel means and supporting each of said corner panel means for movement toward and away from the corresponding ones of said adjacent side and end panels; and said bottom panel means of said inner mold including a central panel portion having side and end edges, and peripheral portions along said edges and pivotal downwardly relative thereto.

27. The molding device as set forth in claim 81, wherein said suspension frame means includes bottom panel frame means supporting said central panel portion, means pivotally interconnecting each of said peripheral portions with said bottom panel frame means, and fluid pressure operable piston and cylinder means for pivotally displacing each said peripheral portion relative to said bottom panel frame means, said piston and cylinder means including cylinder means affixed to said bottom panel frame means and piston rod means having an outer end pivotally interconnected with said peripheral portion.

28. The molding device as set forth in claim 81, wherein said suspension frame means includes bottom panel frame means for said central panel portion, said bottom panel frame means including an outer portion extending outwardly beyond said side and end edges of said central panel portion, each said peripheral portions including a portion overlying the corresponding outer portion of said frame means.

29. A molding device as set forth in claim 81, wherein said suspension frame means includes a bottom frame supporting said bottom panel means of said inner mold and top frame means spaced above said bottom frame and supporting said side and end panels of said outer and inner molds, a plurality of columns between said bottom frame and top frame means and affixed to said bottom frame, and means releasably interconnecting said top frame means and said columns.

30. A molding device as set forth in claim 84, wherein said top frame means includes platform means having openings therethrough, said means interconnecting said top frame means and columns including bolt means fixedly supported by said columns and projecting through said openings in said platform means and having threaded outer ends, and nut means on said outer ends.

31. A molding device as set forth in claim 30, wherein said bolt means have shank portions of a diameter larger than that of said threaded outer ends, an washer means between said platform means and said nut means.

32. A molding device for producing a box-type concrete block, comprising:

an outer mold including bottom panel means, a pair of opposed parallel side panels, and a pair of opposed parallel end panels at right angles to said side panels;

an inner mold inculding bottom panel means spaced above said bottom panel means of said outer mold, a pair of side panels each spaced inwardly from and parallel to one of said side panels of said outer mold, a pair of end panels each spaced inwardly from and parallel to one of said side panels of said outer mold, and corner panel means between adjacent ones of said side and end panels of said inner mold;

support means for said outer and inner molds including means supporting said bottom panel means of said outer mold and suspension frame means supporting said bottom panel means of said inner mold, said suspension frame means further supporting each said side and end panels of said outer and inner molds for movement inwardly and outwardly relative to the corresponding bottom panel means and supporting each of said corner panel means for movement toward and away from the corresponding ones of said adjacent side and end panels;

at least one pair of corresponding ones of said side panels and end panels of said inner and outer molds being provided with openings therethrough; and mold frame means in said openings and spanning the space therebetween, said mold frame means being supported on the panel of the outer mold for movement in opposite directions axially of said openings, and fluid pressure operated piston and cylinder means interconnecting said mold frame means and said panel of said outer mold for displacing said mold frame means in said opposite directions.

33. The molding device as set forth in claim, wherein said piston and cylinder means includes cylinders mounted on said panel of the outer mold and having piston rods extending toward said openings, said mold frame means being attached to said piston rods.

34. The molding device as set forth in claim 32, wherein said mold frame means has an end adjacent the opening through the panel of the inner mold, a plurality of bolts secured to said mold frame means at said inner end and extending axially of the opening of said panel of the inner mold, the latter said panel having apertures to receive said bolts, said bolts having heads spaced from said panel of said inner mold in the direction inwardly of said inner mold, said apertures being of a size permitting the passage of said heads of said bolt, and fastening means on said panel of said inner mold for engaging said heads against displacement through said apertures in the direction outwardly of said inner mold.

35. A molding device as set forth in claim 34, wherein said fastening means includes plate members slidably supported on said panel of the inner mold, said plate members having holes therethrough, said holes including a first portion of a size permitting the passage of said heads of said bolts and a second portion continuous with said first portion and of a size substantially the same as the diameter of said bolts, wedges on said plate members adjacent said second portions of said holes, the thickness of said wedges increasing in the direction from the ends of said second portions communicating with said first portions, said plate members being slidable between engaging and releasing positions, and said wedges engaging said bolt heads when said plate members are in said engaging positions.

36. The molding device as set forth in claim 35 wherein said plate members have opposed adjacent ends, and fluid operated piston and cylinder means interconnecting said adjacent ends and including a cylinder mounted on one of said plate members and a piston rod having an outer end attached to the other of said plate members.

37. The molding device as set forth in claim 36, wherein each of said plate members is U-shaped and bounds a portion of the opening through said anel of the inner mold, the ends of the legs of the U-shaped members being positioned to define said adjacent ends.

38. The molding device as set forth in claim 36, and means on said panel of the inner mold for guiding said sliding movement of said plate members.

* * * * *